US011434714B2

(12) United States Patent
Machocki

(10) Patent No.: US 11,434,714 B2
(45) Date of Patent: Sep. 6, 2022

(54) ADJUSTABLE SEAL FOR SEALING A FLUID FLOW AT A WELLHEAD

(71) Applicant: Saudi Arabian Oil Company, Dhahran (SA)

(72) Inventor: Krzysztof Karol Machocki, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/140,566

(22) Filed: Jan. 4, 2021

(65) Prior Publication Data

US 2022/0213758 A1 Jul. 7, 2022

(51) Int. Cl.
*E21B 33/128* (2006.01)
*E21B 33/12* (2006.01)

(52) U.S. Cl.
CPC ..... *E21B 33/128* (2013.01); *E21B 33/12* (2013.01); *E21B 33/1208* (2013.01)

(58) Field of Classification Search
CPC ..... E21B 33/12; E21B 33/128; E21B 33/1208
See application file for complete search history.

(56) References Cited

U.S. PATENT DOCUMENTS

| | | | |
|---|---|---|---|
| 891,957 | A | 6/1908 | Schubert |
| 2,043,225 | A | 6/1936 | Armentrout et al. |
| 2,110,913 | A | 3/1938 | Lowrey |
| 2,227,729 | A | 1/1941 | Lynes |
| 2,286,673 | A | 6/1942 | Douglas |
| 2,305,062 | A | 12/1942 | Church et al. |
| 2,344,120 | A | 3/1944 | Baker |
| 2,757,738 | A | 9/1948 | Ritchey |
| 2,509,608 | A | 5/1950 | Penfield |
| 2,688,369 | A | 9/1954 | Broyles |

(Continued)

FOREIGN PATENT DOCUMENTS

| | | |
|---|---|---|
| CA | 1226325 | 9/1987 |
| CA | 2249432 | 9/2005 |

(Continued)

OTHER PUBLICATIONS

Akersolutions, "Aker MH CCTC Improving Safety," Akersolutions, Jan. 2008, 12 pages.

(Continued)

*Primary Examiner* — Yong-Suk (Philip) Ro
(74) *Attorney, Agent, or Firm* — Fish & Richardson P.C.

(57) ABSTRACT

An assembly and a method for sealing a tubular in a wellbore, where the wellbore sealing assembly includes a hollow housing body and a seal. The hollow housing body is configured to receive a tubular. The seal is positioned within the hollow housing body and has a first movable end and a second movable end. A first seal surface and a first hollow housing inner surface define a first hollow housing cavity. A second seal surface and a second hollow housing surface define a second hollow housing cavity. The seal is configured to seal fluid in the first hollow housing cavity from fluid in the second hollow housing cavity when the tubular is disposed in the hollow housing body. The first movable end and the second movable end are moveable to change a length of a third seal surface shared between the seal and the tubular.

19 Claims, 6 Drawing Sheets

(56) References Cited

U.S. PATENT DOCUMENTS 2,690,897 A 10/1954 Clark
2,719,363 A 10/1955 Richard et al.
2,795,279 A 6/1957 Erich
2,799,641 A 7/1957 Gordon
2,805,045 A 9/1957 Goodwin
2,822,150 A 2/1958 Muse et al.
2,841,226 A 7/1958 Comad et al.
2,899,000 A 8/1959 Medders et al.
2,927,775 A 3/1960 Hildebrandt
3,016,244 A 1/1962 Friedrich et al.
3,028,915 A 4/1962 Jennings
3,087,552 A 4/1963 Graham
3,102,599 A 9/1963 Hillburn
3,103,975 A 9/1963 Hanson
3,104,711 A 9/1963 Haagensen
3,114,875 A 12/1963 Haagensen
3,133,592 A 5/1964 Tomberlin
3,137,347 A 6/1964 Parker
3,149,672 A 9/1964 Joseph et al.
3,169,577 A 2/1965 Erich
3,170,519 A 2/1965 Haagensen
3,211,220 A 10/1965 Erich
3,220,478 A 11/1965 Kinzbach
3,236,307 A 2/1966 Brown
3,253,336 A 5/1966 Brown
3,268,003 A 8/1966 Essary
3,331,439 A 7/1967 Lawrence
3,428,125 A 2/1969 Parker
3,468,373 A 9/1969 Smith
3,522,848 A 8/1970 New
3,547,192 A 12/1970 Claridge et al.
3,547,193 A 12/1970 Gill
3,642,066 A 2/1972 Gill
3,656,564 A 4/1972 Brown
3,696,866 A 10/1972 Dryden
3,839,791 A 10/1974 Feamster
3,862,662 A 1/1975 Kern
3,874,450 A 4/1975 Kern
3,931,856 A 1/1976 Barnes
3,946,809 A 3/1976 Hagedorn
3,948,319 A 4/1976 Pritchett
4,008,762 A 2/1977 Fisher et al.
4,010,799 A 3/1977 Kern et al.
4,064,211 A 12/1977 Wood
4,084,637 A 4/1978 Todd
4,135,579 A 1/1979 Rowland et al.
4,140,179 A 2/1979 Kasevich et al.
4,140,180 A 2/1979 Bridges et al.
4,144,935 A 3/1979 Bridges et al.
4,191,493 A 3/1980 Hansson et al.
4,193,448 A 3/1980 Jearnbey
4,193,451 A 3/1980 Dauphine
4,196,329 A 4/1980 Rowland et al.
4,199,025 A 4/1980 Carpenter
4,265,307 A 5/1981 Elkins
RE30,738 E 9/1981 Bridges et al.
4,301,865 A 11/1981 Kasevich et al.
4,320,801 A 3/1982 Rowland et al.
4,334,928 A 6/1982 Hara
4,337,653 A 7/1982 Chauffe
4,343,651 A 8/1982 Yazu et al.
4,354,559 A 10/1982 Johnson
4,373,581 A 2/1983 Toellner
4,394,170 A 7/1983 Sawaoka et al.
4,396,062 A 8/1983 Iskander
4,412,585 A 11/1983 Bouck
4,413,642 A 11/1983 Smith et al.
4,449,585 A 5/1984 Bridges et al.
4,457,365 A 7/1984 Kasevich et al.
4,470,459 A 9/1984 Copland
4,476,926 A 10/1984 Bridges et al.
4,484,627 A 11/1984 Perkins
4,485,868 A 12/1984 Sresty et al.
4,485,869 A 12/1984 Sresty et al.
4,487,257 A 12/1984 Dauphine
4,495,990 A 1/1985 Titus et al.
4,498,535 A 2/1985 Bridges
4,499,948 A 2/1985 Perkins
4,508,168 A 4/1985 Heeren
4,513,815 A 4/1985 Rundell et al.
4,524,826 A 6/1985 Savage
4,524,827 A 6/1985 Bridges et al.
4,545,435 A 10/1985 Bridges et al.
4,553,592 A 11/1985 Looney et al.
4,557,327 A 12/1985 Kinley et al.
4,576,231 A 3/1986 Dowling et al.
4,583,589 A 4/1986 Kasevich
4,592,423 A 6/1986 Savage et al.
4,612,988 A 9/1986 Segalman
4,620,593 A 11/1986 Haagensen
4,636,934 A 1/1987 Schwendemann
4,640,372 A * 2/1987 Davis ..... E21B 21/001 166/90.1
RE32,345 E 3/1987 Wood
4,651,831 A 3/1987 Baugh
4,660,636 A 4/1987 Rundell et al.
4,705,108 A 11/1987 Little et al.
4,817,711 A 4/1989 Jearnbey
5,012,863 A 5/1991 Springer
5,018,580 A 5/1991 Skipper
5,037,704 A 8/1991 Nakai et al.
5,055,180 A 10/1991 Klaila
5,068,819 A 11/1991 Misra et al.
5,070,952 A 12/1991 Neff
5,074,355 A 12/1991 Lennon
5,082,054 A 1/1992 Kiamanesh
5,092,056 A 3/1992 Deaton
5,107,705 A 4/1992 Wraight et al.
5,107,931 A 4/1992 Valka et al.
5,178,215 A * 1/1993 Yenulis ..... E21B 33/085 166/95.1
5,228,518 A 7/1993 Wilson et al.
5,236,039 A 8/1993 Edelstein et al.
5,273,108 A * 12/1993 Piper ..... E21B 33/06 166/90.1
5,278,550 A 1/1994 Rhein-Knudsen et al.
5,319,272 A 6/1994 Raad
5,388,648 A 2/1995 Jordan, Jr.
5,490,598 A 2/1996 Adams
5,501,248 A 3/1996 Kiest, Jr.
5,690,826 A 11/1997 Cravello
5,803,186 A 9/1998 Berger et al.
5,803,666 A 9/1998 Keller
5,813,480 A 9/1998 Zaleski, Jr. et al.
5,853,049 A 12/1998 Keller
5,890,540 A 4/1999 Pia et al.
5,899,274 A 5/1999 Frauenfeld et al.
5,947,213 A 9/1999 Angle
5,955,666 A 9/1999 Mullins
5,958,236 A 9/1999 Bakula
RE36,362 E 11/1999 Jackson
6,012,526 A 1/2000 Jennings et al.
6,032,742 A 3/2000 Tomlin et al.
6,041,860 A 3/2000 Nazzal et al.
6,047,239 A 4/2000 Berger et al.
6,096,436 A 8/2000 Inspektor
6,129,152 A 10/2000 Hosie et al.
6,170,531 B1 1/2001 Jung et al.
6,173,795 B1 1/2001 McGarian et al.
6,189,611 B1 2/2001 Kasevich
6,206,108 B1 3/2001 MacDonald et al.
6,254,844 B1 7/2001 Takeuchi et al.
6,268,726 B1 7/2001 Prammer
6,269,953 B1 8/2001 Seyffert et al.
6,290,068 B1 9/2001 Adams et al.
6,305,471 B1 10/2001 Milloy
6,325,216 B1 12/2001 Seyffert et al.
6,328,111 B1 12/2001 Bearden et al.
6,330,913 B1 12/2001 Langseth et al.
6,354,371 B1 3/2002 O'Blanc
6,371,302 B1 4/2002 Adams et al.
6,413,399 B1 7/2002 Kasevich
6,443,228 B1 9/2002 Aronstam
6,454,099 B1 9/2002 Adams et al.

(56) References Cited

U.S. PATENT DOCUMENTS 6,510,947 B1 1/2003 Schulte et al.
6,534,980 B2 2/2003 Toufaily et al.
6,544,411 B2 4/2003 Varandaraj
6,561,269 B1 5/2003 Brown et al.
6,571,877 B1 6/2003 Van Bilderbeek
6,607,080 B2 8/2003 Winkler et al.
6,612,384 B1 9/2003 Singh et al.
6,622,554 B2 9/2003 Manke et al.
6,623,850 B2 9/2003 Kukino et al.
6,629,610 B1 10/2003 Adams et al.
6,637,092 B1 10/2003 Menzel
6,648,082 B2 11/2003 Schultz et al.
6,678,616 B1 1/2004 Winkler et al.
6,722,504 B2 4/2004 Schulte et al.
6,741,000 B2 5/2004 Newcomb
6,761,230 B2 7/2004 Cross et al.
6,814,141 B2 11/2004 Huh et al.
6,827,145 B2 12/2004 Fotland et al.
6,845,818 B2 1/2005 Tutuncu et al.
6,850,068 B2 2/2005 Chernali et al.
6,895,678 B2 5/2005 Ash et al.
6,912,177 B2 6/2005 Smith
6,971,265 B1 12/2005 Sheppard et al.
6,993,432 B2 1/2006 Jenkins et al.
7,000,777 B2 2/2006 Adams et al.
7,013,992 B2 3/2006 Tessari et al.
7,048,051 B2 5/2006 McQueen
7,063,155 B2 6/2006 Ruttley
7,086,463 B2 8/2006 Ringgenberg et al.
7,091,460 B2 8/2006 Kinzer
7,109,457 B2 9/2006 Kinzer
7,115,847 B2 10/2006 Kinzer
7,124,819 B2 10/2006 Ciglenec et al.
7,168,507 B2 1/2007 Downton
7,216,767 B2 5/2007 Schulte et al.
7,312,428 B2 12/2007 Kinzer
7,322,776 B2 1/2008 Webb et al.
7,331,385 B2 2/2008 Symington
7,376,514 B2 5/2008 Habashy et al.
7,380,590 B2 * 6/2008 Hughes ..... E21B 33/085 166/84.3
7,387,174 B2 6/2008 Lurie
7,445,041 B2 11/2008 O'Brien
7,455,117 B1 11/2008 Hall et al.
7,461,693 B2 12/2008 Considine et al.
7,484,561 B2 2/2009 Bridges
7,539,548 B2 5/2009 Dhawan
7,562,708 B2 7/2009 Cogliandro et al.
7,629,497 B2 12/2009 Pringle
7,631,691 B2 12/2009 Symington et al.
7,647,980 B2 1/2010 Corre et al.
7,650,269 B2 1/2010 Rodney
7,677,673 B2 3/2010 Tranquilla et al.
7,730,625 B2 6/2010 Blake
7,743,823 B2 * 6/2010 Hughes ..... E21B 33/085 166/84.3
7,779,903 B2 8/2010 Bailey et al.
7,951,482 B2 5/2011 Ichinose et al.
7,980,392 B2 7/2011 Varco
8,067,865 B2 11/2011 Savant
8,237,444 B2 8/2012 Simon
8,245,792 B2 8/2012 Trinh et al.
8,275,549 B2 9/2012 Sabag et al.
8,286,734 B2 10/2012 Hannegan et al.
8,484,858 B2 7/2013 Brannigan et al.
8,511,404 B2 8/2013 Rasheed
8,526,171 B2 9/2013 Wu et al.
8,528,668 B2 9/2013 Rasheed
8,567,491 B2 10/2013 Lurie
8,794,062 B2 8/2014 DiFoggio et al.
8,884,624 B2 11/2014 Homan et al.
8,925,213 B2 1/2015 Sallwasser
8,960,215 B2 2/2015 Cui et al.
8,973,680 B2 3/2015 MacKenzie
9,051,810 B1 6/2015 Cuffe et al.
9,109,429 B2 8/2015 Xu et al.
9,217,323 B2 12/2015 Clark
9,222,350 B2 12/2015 Vaughn et al.
9,238,953 B2 1/2016 Fleming et al.
9,238,961 B2 1/2016 Bedouet
9,250,339 B2 2/2016 Ramirez
9,353,589 B2 5/2016 Hekelaar
9,394,782 B2 7/2016 DiGiovanni et al.
9,435,159 B2 9/2016 Scott
9,464,487 B1 10/2016 Zurn
9,470,059 B2 10/2016 Zhou
9,494,010 B2 11/2016 Flores
9,494,032 B2 11/2016 Roberson et al.
9,512,708 B2 12/2016 Hay
9,528,366 B2 12/2016 Selman et al.
9,562,987 B2 2/2017 Guner et al.
9,617,815 B2 4/2017 Scwartze et al.
9,664,011 B2 5/2017 Kruspe et al.
9,702,211 B2 7/2017 Tinnen
9,731,471 B2 8/2017 Schaedler et al.
9,739,141 B2 8/2017 Zeng et al.
9,845,653 B2 12/2017 Hannegan et al.
9,885,232 B2 2/2018 Close et al.
10,000,983 B2 6/2018 Jackson et al.
10,174,577 B2 1/2019 Leuchtenberg et al.
10,233,372 B2 3/2019 Ramasamy et al.
10,329,877 B2 6/2019 Simpson et al.
10,392,910 B2 8/2019 Walton et al.
10,394,193 B2 8/2019 Li et al.
10,544,640 B2 1/2020 Hekelaar et al.
10,724,324 B2 7/2020 Boulanger
2002/0066563 A1 6/2002 Langseth et al.
2003/0159776 A1 8/2003 Graham
2003/0230526 A1 12/2003 Okabayshi et al.
2004/0182574 A1 9/2004 Sarmad et al.
2004/0256103 A1 12/2004 Batarseh
2005/0022987 A1 2/2005 Green et al.
2005/0092523 A1 5/2005 McCaskill et al.
2005/0259512 A1 11/2005 Mandal
2006/0016592 A1 1/2006 Wu
2006/0106541 A1 5/2006 Hassan et al.
2006/0144620 A1 7/2006 Cooper
2006/0185843 A1 8/2006 Smith
2006/0248949 A1 11/2006 Gregory et al.
2006/0249307 A1 11/2006 Ritter
2007/0131591 A1 6/2007 Pringle
2007/0137852 A1 6/2007 Considine et al.
2007/0175633 A1 8/2007 Kosmala
2007/0187089 A1 8/2007 Bridges
2007/0204994 A1 9/2007 Wimmersperg
2007/0289736 A1 12/2007 Kearl et al.
2008/0007421 A1 1/2008 Liu et al.
2008/0047337 A1 2/2008 Chemali et al.
2008/0053652 A1 3/2008 Corre et al.
2008/0173480 A1 7/2008 Annaiyappa et al.
2008/0190822 A1 8/2008 Young
2008/0308282 A1 12/2008 Standridge et al.
2009/0153354 A1 6/2009 Daussin
2009/0164125 A1 6/2009 Bordakov et al.
2009/0178809 A1 7/2009 Jeffryes et al.
2009/0259446 A1 10/2009 Zhang et al.
2010/0006339 A1 1/2010 Desai
2010/0089583 A1 4/2010 Xu et al.
2010/0276209 A1 11/2010 Yong et al.
2010/0282511 A1 11/2010 Maranuk
2011/0011576 A1 1/2011 Cavender et al.
2011/0024195 A1 2/2011 Hoyer et al.
2011/0120732 A1 5/2011 Lurie
2011/0155368 A1 6/2011 El-Khazindar
2011/0169353 A1 7/2011 Endo
2012/0012319 A1 1/2012 Dennis
2012/0111578 A1 5/2012 Tverlid
2012/0132418 A1 5/2012 McClung
2012/0152543 A1 6/2012 Davis
2012/0173196 A1 7/2012 Miszewski
2012/0186817 A1 7/2012 Gibson et al.
2012/0222854 A1 9/2012 McClung, III
2012/0227983 A1 9/2012 Lymberopoulous et al.
2012/0273187 A1 11/2012 Hall

(56) References Cited

U.S. PATENT DOCUMENTS

| | | | |
|---|---|---|---|
| 2013/0008653 | A1 | 1/2013 | Schultz et al. |
| 2013/0008671 | A1 | 1/2013 | Booth |
| 2013/0025943 | A1 | 1/2013 | Kumar |
| 2013/0076525 | A1 | 3/2013 | Vu et al. |
| 2013/0119830 | A1 | 5/2013 | Hautz |
| 2013/0125642 | A1 | 5/2013 | Parfitt |
| 2013/0126164 | A1 | 5/2013 | Sweatman et al. |
| 2013/0146359 | A1 | 6/2013 | Koederitz |
| 2013/0213637 | A1 | 8/2013 | Kearl |
| 2013/0255936 | A1 | 10/2013 | Statoilydro et al. |
| 2014/0083771 | A1 | 3/2014 | Clark |
| 2014/0183143 | A1 | 7/2014 | Cady et al. |
| 2014/0231075 | A1 | 8/2014 | Springett et al. |
| 2014/0231147 | A1 | 8/2014 | Bozso et al. |
| 2014/0238658 | A1 | 8/2014 | Wilson et al. |
| 2014/0246235 | A1 | 9/2014 | Yao |
| 2014/0251894 | A1 | 9/2014 | Larson et al. |
| 2014/0265337 | A1 | 9/2014 | Harding et al. |
| 2014/0278111 | A1 | 9/2014 | Gerrie et al. |
| 2014/0291023 | A1 | 10/2014 | Edbury |
| 2014/0300895 | A1 | 10/2014 | Pope et al. |
| 2014/0333754 | A1 | 11/2014 | Graves et al. |
| 2014/0360778 | A1 | 12/2014 | Batarseh |
| 2014/0375468 | A1 | 12/2014 | Wilkinson et al. |
| 2015/0020908 | A1 | 1/2015 | Warren |
| 2015/0021240 | A1 | 1/2015 | Wardell et al. |
| 2015/0027724 | A1 | 1/2015 | Symms |
| 2015/0083422 | A1 | 3/2015 | Pritchard |
| 2015/0091737 | A1 | 4/2015 | Richardson et al. |
| 2015/0101864 | A1 | 4/2015 | May |
| 2015/0159467 | A1 | 6/2015 | Hartman et al. |
| 2015/0211362 | A1 | 7/2015 | Rogers |
| 2015/0267500 | A1 | 9/2015 | Van Dongen |
| 2015/0290878 | A1 | 10/2015 | Houben et al. |
| 2015/0300151 | A1 | 10/2015 | Mohaghegh |
| 2016/0053572 | A1 | 2/2016 | Snoswell |
| 2016/0053604 | A1 | 2/2016 | Abbassian |
| 2016/0076357 | A1 | 3/2016 | Hbaieb |
| 2016/0115783 | A1 | 4/2016 | Zeng et al. |
| 2016/0130928 | A1 | 5/2016 | Torrione |
| 2016/0153240 | A1 | 6/2016 | Braga et al. |
| 2016/0160106 | A1 | 6/2016 | Jamison et al. |
| 2016/0164377 | A1 | 6/2016 | Gauthier |
| 2016/0237810 | A1 | 8/2016 | Beaman et al. |
| 2016/0247316 | A1 | 8/2016 | Whalley et al. |
| 2016/0356125 | A1 | 12/2016 | Bello et al. |
| 2017/0051785 | A1 | 2/2017 | Cooper |
| 2017/0161885 | A1 | 6/2017 | Parmeshwar et al. |
| 2017/0234104 | A1 | 8/2017 | James |
| 2017/0292376 | A1 | 10/2017 | Kumar et al. |
| 2017/0314335 | A1 | 11/2017 | Kosonde et al. |
| 2017/0328196 | A1 | 11/2017 | Shi et al. |
| 2017/0328197 | A1 | 11/2017 | Shi et al. |
| 2017/0342776 | A1 | 11/2017 | Bullock et al. |
| 2017/0343006 | A1 | 11/2017 | Ehrsann |
| 2017/0346371 | A1 | 11/2017 | Gruetzner |
| 2017/0350201 | A1 | 12/2017 | Shi et al. |
| 2017/0350241 | A1 | 12/2017 | Shi |
| 2018/0010030 | A1 | 1/2018 | Ramasamy et al. |
| 2018/0010419 | A1 | 1/2018 | Livescu et al. |
| 2018/0171772 | A1 | 6/2018 | Rodney |
| 2018/0187498 | A1 | 7/2018 | Soto et al. |
| 2018/0265416 | A1 | 9/2018 | Ishida et al. |
| 2018/0326679 | A1 | 11/2018 | Weisenberg et al. |
| 2018/0334883 | A1 | 11/2018 | Williamson |
| 2018/0363404 | A1 | 12/2018 | Faugstad |
| 2019/0049054 | A1 | 2/2019 | Gunnarsson et al. |
| 2019/0101872 | A1 | 4/2019 | Li |
| 2019/0227499 | A1 | 7/2019 | Li et al. |
| 2019/0257180 | A1 | 8/2019 | Kriesels et al. |
| 2019/0316463 | A1 | 10/2019 | Pfrenger et al. |
| 2020/0032638 | A1 | 1/2020 | Ezzeddine |
| 2020/0157910 | A1 | 5/2020 | Sehsah et al. |
| 2020/0220431 | A1 | 7/2020 | Wrighton |

FOREIGN PATENT DOCUMENTS

| | | |
|---|---|---|
| CA | 2537585 | 8/2006 |
| CA | 2669721 | 7/2011 |
| CA | 2594042 | 8/2012 |
| CN | 200989202 | 12/2007 |
| CN | 203232293 | 10/2013 |
| CN | 204627586 | 9/2015 |
| CN | 107462222 | 12/2017 |
| CN | 110571475 | 12/2019 |
| DE | 102008001607 | 11/2009 |
| DE | 102012022453 | 5/2014 |
| DE | 102013200450 | 7/2014 |
| DE | 102012205757 | 8/2014 |
| EP | 2317068 | 5/2011 |
| EP | 2574722 | 4/2013 |
| EP | 2737173 | 6/2014 |
| GB | 2124855 | 2/1984 |
| GB | 2357305 | 6/2001 |
| GB | 2399515 | 9/2004 |
| GB | 2422125 | 7/2006 |
| GB | 2532967 | 6/2016 |
| JP | 2009067609 | 4/2009 |
| JP | 4275896 | 6/2009 |
| JP | 5013156 | 8/2012 |
| JP | 2013110910 | 6/2013 |
| NO | 343139 | 11/2018 |
| NO | 20161842 | 5/2019 |
| RU | 2282708 | 8/2006 |
| RU | 122531 | 11/2012 |
| WO | WO 1995035429 | 12/1995 |
| WO | WO 1997021904 | 6/1997 |
| WO | WO 2000025942 | 5/2000 |
| WO | WO 2000031374 | 6/2000 |
| WO | WO 2001042622 | 6/2001 |
| WO | WO 2002020944 | 3/2002 |
| WO | WO 2002068793 | 9/2002 |
| WO | WO 2004042185 | 5/2004 |
| WO | WO 2007049026 | 5/2007 |
| WO | WO 2007070305 | 6/2007 |
| WO | WO 2008146017 | 12/2008 |
| WO | WO 2009020889 | 2/2009 |
| WO | WO 2009113895 | 9/2009 |
| WO | WO 2010105177 | 9/2010 |
| WO | WO 2010144989 | 12/2010 |
| WO | WO 2011038170 | 3/2011 |
| WO | WO 2011042622 | 6/2011 |
| WO | WO 2012007407 | 1/2012 |
| WO | WO 2013016095 | 1/2013 |
| WO | WO 2013148510 | 10/2013 |
| WO | WO 2014127035 | 8/2014 |
| WO | WO 2015095155 | 6/2015 |
| WO | WO 2016178005 | 11/2016 |
| WO | WO 2017011078 | 1/2017 |
| WO | WO 2017035041 | 3/2017 |
| WO | WO 2017132297 | 8/2017 |
| WO | WO 2017196303 | 11/2017 |
| WO | WO 2018022198 | 2/2018 |
| WO | WO 2018169991 | 9/2018 |
| WO | WO 2019040091 | 2/2019 |
| WO | WO 2019055240 | 3/2019 |
| WO | WO 2019089926 | 5/2019 |
| WO | WO 2019108931 | 6/2019 |
| WO | WO 2019169067 | 9/2019 |
| WO | WO 2019236288 | 12/2019 |
| WO | WO 2019246263 | 12/2019 |

OTHER PUBLICATIONS

Anwar et al.,"Fog computing: an overview of big IoT data analytics," Article ID 7157192, Hindawi, Wiley, Wireless communications and mobile computing, May 2018, 2018: 1-22, 23 pages.

Artymiuk et al., "The new drilling control and monitoring system," Acta Montanistica Slovaca, Sep. 2004, 9:3 (145-151), 7 pages.

Ashby et al., "Coiled Tubing Conveyed Video Camera and Multi-Arm Caliper Liner Damage Diagnostics Post Plug and Perf Frac," SPE-172622-MS, Society of Petroleum Engineers (SPE), presented

(56) References Cited

OTHER PUBLICATIONS at the SPE Middle East Oil and Gas Show and Conference, Mar. 8-11, 2015, 12 pages.
Bestebit, "IADC Dull Grading for PDC Drill Bits," Beste Bit, SPE/IADC 23939, Society of Petroleum Engineers (SPE), International Association of Drilling Contractors (IADC), 1992, 52 pages.
Bilal et al., "Potentials, trends, and prospects in edge technologies: Fog, cloudlet, mobile edge, and micro data centers," Computer Networks, Elsevier, Oct. 2017, 130: 94-120, 27 pages.
Carpenter, "Advancing Deepwater Kick Detection," JPT, 68:5, May 2016, 2 pages.
Commer et al., "New advances in three-dimensional controlled-source electromagnetic inversion," Geophys. J. Int., 2008, 172: 513-535, 23 pages.
Dickens et al., "An LED array-based light induced fluorescence sensor for real-time process and field monitoring," Sensors and Actuators B: Chemical, Elsevier, Apr. 2011, 158:1 (35-42), 8 pages.
Dong et al., "Dual Substitution and Spark Plasma Sintering to Improve Ionic Conductivity of Garnet Li7La3Zr2O12," MDPI, Nanomaterials, 9:721, 2019, 10 pages.
downholediagnostic.com [online] "Acoustic Fluid Level Surveys," retrieved from URL <https://www.downholediagnostic.com/fluid-level> retrieved on Mar. 27, 2020, available on or before 2018, 13 pages.
edition.cnn.com [online], "Revolutionary gel is five times stronger than steel," retrieved from URL <https://edition.cnn.com/style/article/hydrogel-steel-japan/index.html>, retrieved on Apr. 2, 2020, available on or before Jul. 16, 2017, 6 pages.
Gemmeke and Ruiter, "3D ultrasound computer tomography for medical imagining," Nuclear Instruments and Methods in Physics Research A 580 (1057-1065), Oct. 1, 2007, 9 pages.
Halliburton.com [online], "Drill Bits and Services Solutions Catalogs," retrieved from URL: <https://www.halliburton.com/content/dam/ps/public/sdbs/sdbs_contents/Books_and_Catalogs/web/DBS-Solution.pdf> on Sep. 26, 2019, Copyright 2014, 64 pages.
Hopkin, "Factor Affecting Cuttings Removal during Rotary Drilling," Journal of Petroleum Technology 19.06, Jun. 1967, 8 pages.
Ji et al., "Submicron Sized Nb Doped Lithium Garnet for High Ionic Conductivity Solid Electrolyte and Performance of All Solid-State Lithium Battery," Preprints, doi:10.20944/preprints201912.0307.v1, Dec. 2019, 10 pages.
Johnson et al., "Advanced Deepwater Kick Detection," IADC/SPE 167990, Society of Petroleum Engineers (SPE), International Association of Drilling Contractors (IADC), presented at the 2014 IADC/SPE Drilling Conference and Exhibition, Mar. 4-6, 2014, 10 pages.
Johnson, "Design and Testing of a Laboratory Ultrasonic Data Acquisition System for Tomography" Thesis for the degree of Master of Science in Mining and Minerals Engineering, Virginia Polytechnic Institute and State University, Dec. 2, 2004, 108 pages.
King et al., "Atomic layer deposition of TiO2 films on particles in a fluidized bed reactor," Powder Technology, 183:3 (356-363), Apr. 2008, 8 pages.
Li et al., 3D Printed Hybrid Electrodes for Lithium-ion Batteries, Missouri University of Science and Technology, Washington State University; ECS Transactions, 77:11 (1209-1218), 2017, 11 pages.
Liu et al., "Flow visualization and measurement in flow field of a torque converter," Mechanic automation and control Engineering, Second International Conference on IEEE, Jul. 15, 2011, 1329-1331, 3 pages.
Liu et al., "Superstrong micro-grained poly crystalline diamond compact through work hardening under high pressure," Appl. Phys. Lett. Feb. 2018, 112:061901, 6 pages.
Luo et al., "Simple Charts to Determine Hole Cleaning Requirements in Deviated Wells," IADC/SPE 27486, International Association of Drilling Contractors (IADC), Society of Petroleum Engineers (SPE), presented at the 1994 SPE/IADC Drilling Conference, Society of Petroleum Engineers, Feb. 15-18, 1994, 7 pages.
Maurer, "The Perfect Cleaning Theory of Rotary Drilling," Journal of Petroleum Technology 14.11, 1962, 5 pages.
nature.com [online], "Mechanical Behavior of a Soft Hydrogel Reinforced with Three-Dimensional Printed Microfibre Scaffolds," retrieved from URL <https://www.nature.com/articles/s41598-018-19502-y>, retrieved on Apr. 2, 2020, available on or before Jan. 19, 2018, 47 pages.
Nuth, "Smart oil field distributed computing," The Industrial Ethernet Book, Nov. 2014, 85:14 (1-3), 3 pages.
Olver, "Compact Antenna Test Ranges," Seventh International Conference on Antennas and Propagation IEEE , Apr. 15-18, 1991, 10 pages.
Paiaman et al., "Effect of Drilling Fluid Properties on Rate Penetration," Nafta 60:3 (129-134), 2009, 6 pages.
Parini et al., "Chapter 3: Antenna measurements," in Theory and Practice of Modern Antenna Range Measurements, IET editorial, 2014, 30 pages.
petrowiki.org [online], "Hole Cleaning," retrieved on Jan. 25, 2019, retrieved from URL <http://petrowiki.org/Hole_cleaning#Annular-fluid_velocity>, 8 pages.
petrowiki.org [online], "Kicks," Petrowiki, available on or before Jun. 26, 2015, retrieved on Jan. 24, 2018, retrieved from URL <https://petrowiki.org/Kicks>, 6 pages.
Ranjbar, "Cutting Transport in Inclined and Horizontal Wellbore," University of Stavanger, Faculty of Science and Technology, Master's Thesis, Jul. 6, 2010, 137 pages.
Rasi, "Hold Cleaning in Large, High-Angle Wellbores," IADC/SPE 27464, International Association of Drilling Contractors (IADC), Society of Petroleum Engineers (SPE), presented at the 1994 SPE/IADC Drilling Conference, Feb. 15-18, 1994, 12 pages.
rigzone.com [online], "How does Well Control Work?" Rigzone, available on or before 1999, retrieved on Jan. 24, 2019, retrieved from URL <https://www.rigzone.com/training/insight.asp?insight_id=304&c_id>, 5 pages.
Robinson and Morgan, "Effect of Hole Cleaning on Drilling Rate Performance," Paper Aade-04-Df-Ho-42, AADE 2004 Drilling Fluids Conference, Houston, Texas, Apr. 6-7, 2004, 7 pages.
Robinson, "Economic Consequences of Poor Solids and Control," AADE 2006 Fluids Conference and Houston, Texas, Apr. 11-12, 2006, 9 pages.
Ruiter et al., "3D ultrasound computer tomography of the breast: A new era?" European Journal of Radiology 81S1, Sep. 2012, 2 pages.
sageoiltools.com [online] "Fluid Level & Dynamometer Instruments for Analysis due Optimization of Oil and Gas Wells," retrieved from URL <http://www.sageoiltools.com/>, retrieved on Mar. 27, 2020, available on or before 2019, 3 pages.
Schlumberger, "CERTIS: Retrievable, single-trip, production-level isolation system," www.slb.com/CERTIS, 2017, 2 pages.
Schlumberger, "First Rigless ESP Retrieval and Replacement with Slickline, Offshore Congo: Zeitecs Shuttle System Eliminates Need to Mobilize a Workover Rig," slb.com/zeitecs, 2016, 1 page.
Schlumberger, "The Lifting Business," Offshore Engineer, Mar. 2017, 1 page.
Schlumberger, "Zeitecs Shuttle System Decreases ESP Replacement Time by 87%: Customer ESP riglessly retrieved in less than 2 days on coiled tubing," slb.com/zeitecs, 2015, 1 page.
Schlumberger, "Zeitecs Shuttle System Reduces Deferred Production Even Before ESP is Commissioned, Offshore Africa: Third Party ESP developed fault during installation and was retrieved on rods, enabling operator to continue running tubing without waiting on replacement," slb.com/zeitecs, 2016, 2 pages.
Schlumberger, "Zeitecs Shuttle: Rigless ESP replacement system," Brochure, 8 pages.
Schlumberger, "Zeitecs Shuttle: Rigless ESP replacement system," Schlumberger, 2017, 2 pages.
Sifferman et al., "Drilling cutting transport in full scale vertical annuli," Journal of Petroleum Technology 26.11, 48th Annual Fall Meeting of the Society of Petroleum Engineers of AIME, Las Vegas, Sep. 30-Oct. 3, 1973, 12 pages.
slb.com' [online] "Technical Paper: ESP Retrievable Technology: A Solution to Enhance ESP Production While Minimizing Costs," SPE 156189 presented in 2012, retrieved from URL <http://www.slb.com/resources/technical_papers/artificial_lift/156189.aspx>, retrieved on Nov. 2, 2018, 1 pages.

(56) References Cited

OTHER PUBLICATIONS slb.com' [online], "Zeitecs Shuttle Rigless ESP Replacement System," retrieved from URL <http://www.slb.com/services/production/artificial_lift/submersible/zeitecs-shuttle.aspx?t=3>, available on or before May 31, 2017, retrieved on Nov. 2, 2018, 3 pages.
Sulzer Metco, "An Introduction to Thermal Spray," 4, 2013, 24 pages.
Unegbu Celestine Tobenna, "Hole Cleaning Hydraulics," Universitetet o Stavanger, Faculty of Science and Technology, Master's Thesis, Jun. 15, 2010, 75 pages.
Weatherford, "RFID Advanced Reservoir Management System Optimizes Injection Well Design, Improves Reservoir Management," Weatherford.com, 2013, 2 pages.
Wei et al., "The Fabrication of All-Solid-State Lithium-Ion Batteries via Spark Plasma Sintering," Metals, 7:372, 2017, 9 pages.
Wellbore Service Tools: Retrievable tools, "RTTS Packer," Halliburton: Completion Tools, 2017, 4 pages.
wikipedia.org [online] "Optical Flowmeters," retrieved from URL <https://en.wikipedia.org/wiki/Flow_measurement#Optical_flowmeters>, retrieved on Mar. 27, 2020, available on or before Jan. 2020, 1 page.
wikipedia.org [online] "Ultrasonic Flow Meter," retrieved from URL <https://en.wikipedia.org/wiki/Ultrasonic_flow_meter> retrieved on Mar. 27, 2020, available on or before Sep. 2019, 3 pages.
wikipedia.org [online], "Surface roughness," retrieved from URL <https://en.wikipedia.org/wiki/Surface_roughness> retrieved on Apr. 2, 2020, available on or before Oct. 2017, 6 pages.
Williams and Bruce, "Carrying Capacity of Drilling Muds," Journal of Petroleum Technology, 3.04: 192, 1951, 10 pages.
Xia et al., "A Cutting Concentration Model of a Vertical Wellbore Annulus in Deep-water Drilling Operation and its Application," Applied Mechanics and Materials, 101-102: 311-314, Sep. 27, 2011, 5 pages.
Xue et al., "Spark plasma sintering plus heat-treatment of Ta-doped Li7La3Zr2O12 solid electrolyte and its ionic conductivity," Mater. Res. Express 2020, 7:025518, 8 pages.
Zhan et al. "Effect of β-to-α Phase Transformation on the Microstructural Development and Mechanical Properties of Fine-Grained Silicon Carbide Ceramics," Journal of the American Ceramic Society 84:5 (945-50), May 2001, 6 pages.
Zhan et al. "Single-wall carbon nanotubes as attractive toughening agents in alumina-based nanocomposites." Nature Materials 2.1, Jan. 2003, 6 pages.
Zhan et al., "Atomic Layer Deposition on Bulk Quantities of Surfactant Modified Single-Walled Carbon Nanotubes," Journal of American Ceramic Society, 91:3 (831-835), Mar. 2008, 5 pages.
Zhang et al, "Increasing Polypropylene High Temperature Stability by Blending Polypropylene-Bonded Hindered Phenol Antioxidant," Macromolecules, 51:5 (1927-1936), 2018, 10 pages.
Zhu et al., "Spark Plasma Sintering of Lithium Aluminum Germanium Phosphate Solid Electrolyte and its Electrochemical Properties," University of British Columbia; Nanomaterials, 9:1086, 2019, 10 pages.
PCT International Search Report and Written Opinion in International Appln. No. PCT/US2022/011151, dated Mar. 21, 2022,14 pages.

* cited by examiner

ADJUSTABLE SEAL FOR SEALING A FLUID FLOW AT A WELLHEAD

TECHNICAL FIELD

This disclosure relates to sealing a fluid flow in a wellhead.

BACKGROUND

Hydrocarbons and fluids in a subterranean reservoir can be produced to the surface of the Earth by forming a well to the subterranean reservoir and flowing the hydrocarbons and the fluids to the surface of the Earth through the well. Wells formed in the subterranean reservoir have wellheads to which components of the well system are connected. The hydrocarbons and the fluids in the well can be pressurized. The wellhead seals the hydrocarbons and the fluids in the well and controls the flow of the hydrocarbons and the fluids out of the well. Some of the components of the well system can pass through the wellhead into or out of the well.

SUMMARY

This disclosure describes technologies related to adjustably sealing a fluid flow at a wellhead.

Implementations of the present disclosure include a wellbore sealing assembly. The wellbore sealing assembly includes a hollow housing body and a seal. The hollow housing body is configured to receive a wellbore tubular and a seal positioned within the hollow housing body. The seal has a first movable end and a second movable end. A first seal surface and a first hollow housing inner surface define a first hollow housing cavity. A second seal surface and a second hollow housing surface define a second hollow housing cavity. The seal is configured to seal wellbore fluid in the first hollow housing cavity from fluid in the second hollow housing cavity when the wellbore tubular is disposed in the hollow housing body and the seal is engaged to the wellbore tubular. Each of the first movable end and the second movable end are moveable to change a length of a third seal surface shared between the seal and the wellbore tubular.

In some implementations, the wellbore sealing assembly further includes a first retainer ring positioned within the hollow housing body and mechanically coupled to the first movable end. The first retainer ring slides within the hollow housing body to move the first movable end. The first retainer ring and the hollow housing body define a first chamber. The first chamber is configured to be pressurized to change a pressure in the first chamber. The first movable end is configured to move responsive to change of the pressure in the first chamber.

In some implementations, the wellbore sealing assembly further includes a second retainer ring positioned within the hollow housing body and mechanically coupled to the second movable end. The second retainer ring slides within the hollow housing body to move the second movable end. The second retainer ring and the hollow housing body define a second chamber. The second chamber is configured to be pressurized to change a pressure in the second chamber. The second movable end is configured to move responsive to change of the pressure in the second chamber.

In some implementations, the wellbore sealing assembly further includes a third chamber defined by an outside surface of the seal and an inside surface of the housing. The third chamber is configured to be pressurized to change a pressure in the third chamber. Changing the pressure in the third chamber changes a sealing force applied by the seal to the wellbore tubular.

In some implementations, the wellbore sealing assembly further includes a pump fluidically coupled to the first chamber, the second chamber, and the third chamber to pressurize the first chamber, the second chamber, and the third chamber.

In some implementations, the wellbore sealing assembly further includes a controller configured to receive signals representing sensed wellbore sealing assembly conditions and transmit a signal to the pump to pressurize the first chamber, the second chamber, or the third chamber based on wellbore sealing assembly conditions. The controller includes multiple sensors configured to be disposed in the hollow housing body. The multiple sensors are operatively coupled to the controller. The sensors are configured to sense wellbore sealing assembly conditions and transmit signals representing the sensed wellbore sealing assembly conditions to the controller.

In some implementations, the controller is further configured to, based on the signals representing the sensed wellbore conditions, calculate a seal length and a seal force to seal wellbore fluid in the first hollow housing cavity from fluid in the second hollow housing cavity when the wellbore tubular is disposed in the hollow housing body and the seal is engaged to the wellbore tubular.

In some implementations, the controller is a non-transitory computer-readable storage medium storing instructions executable by one or more computer processors, the instructions when executed by the one or more computer processors cause the one or more computer processors generate a signal to pressurize the first chamber to move the first movable end of the seal changing the length of the seal, to pressurize the second chamber to move the second movable end of the seal changing the length of the seal, or to pressurize the third chamber to change the sealing force applied by the seal to the wellbore tubular.

Further implementations of the present disclosure include an adjustable wellbore sealing system. The adjustable wellbore sealing system includes a hollow housing body, a seal, a first retainer ring, a second retainer ring, a third chamber, a pump, a controller, and multiple sensors. The hollow housing body is configured to receive a wellbore tubular. The seal is positioned within the hollow housing body. The seal has a first movable end and a second movable end. A first seal surface and a first hollow housing inner surface define a first hollow housing cavity. A second seal surface and a second hollow housing surface define a second hollow housing cavity. The seal is configured to seal wellbore fluid in the first hollow housing cavity from fluid in the second hollow housing cavity when the wellbore tubular is disposed in the hollow housing body and the seal is engaged to the wellbore tubular. Each of the first movable end and the second movable end are configured to change a length of a third sealing surface shared between the seal and the wellbore tubular. The first retainer ring is positioned within the hollow housing body and mechanically coupled to the first movable end. The first retainer ring slides within the hollow housing body to move the first movable end. The first retainer ring and the hollow housing body define a first chamber. The first chamber is configured to be pressurized to change a pressure in the first chamber. The first movable end is configured to move between a first location and a second location responsive to change of the pressure in the first chamber. The second retainer ring is positioned within the hollow housing and mechanically coupled to the second movable end. The second retainer ring slides within the hollow housing body to move the second movable end. The second retainer ring and the hollow housing body define a second chamber. The second chamber is configured to be pressurized to change a pressure in the second chamber. The second movable end is configured to move between a first location and a second location responsive to change of the pressure in the second chamber. The third chamber is defined by an outside surface of the seal and an inside surface of the hollow housing body. The third chamber is configured to be pressurized to change a pressure in the third chamber. Changing the pressure in the third chamber changes a sealing force applied by the seal to the wellbore tubular. The pump is fluidically coupled to the first chamber, the second chamber, and the third chamber. The pump is configured to pressurize the first chamber, the second chamber, and the third chamber. The controller is configured to receive a signal representing a sensed adjustable wellbore sealing system condition and transmit a signal to the pump in response to the adjustable wellbore sealing system condition to change the pressure in the first chamber to move the first movable end of the seal to change the length of the seal, to change the pressure in the second chamber to move the second movable end of the seal to change the length of the seal, and to change the pressure in the third chamber to change the sealing force applied by the seal to the wellbore tubular. The sensors are configured to be disposed in the hollow housing body. The sensors are operatively coupled to the controller. The sensors are configured to sense the adjustable wellbore sealing system condition and transmit signals representing the adjustable wellbore sealing assembly condition to the controller.

In some implementations, the controller is a non-transitory computer-readable storage medium storing instructions executable by one or more computer processors, the instructions when executed by the one or more computer processors cause the one or more computer processors to operatively control the pump.

In some implementations, the controller is further configured to, based on the signals representing the sensed wellbore conditions, calculate a seal length and a seal force to seal wellbore fluid in the first hollow housing cavity from fluid in the second hollow housing cavity when the wellbore tubular is disposed in the hollow housing body and the seal is engaged to the wellbore tubular.

In some implementations, the sensors are configured to determine a wellbore tubular diameter and a wellbore tubular profile and transmit signals representing the wellbore tubular diameter and the wellbore tubular profile to the controller.

In some implementations, the controller moves the first movable end and the second movable end in response to the wellbore tubular diameter or the wellbore tubular profile.

In some implementations, the wellbore sealing system further includes a conduit fluidically coupled to the second hollow housing cavity. The conduit extends through the hollow housing body to an outside surface of the hollow housing body.

In some implementations, the conduit is configured to allow a drilling fluid and a drilling cutting to flow therein.

In some implementations, the conduit is configured to apply a back pressure to the wellbore.

Further implementations of the present disclosure include a method sealing a wellhead with a wellbore sealing assembly in a wellhead of a wellbore in which a wellbore sealing assembly is installed. The wellbore sealing assembly includes a hollow housing body, a seal, a first retainer ring, a second retainer ring, a third chamber, a pump, a controller, and multiple sensors. The hollow housing body is configured to receive a wellbore tubular. The seal is positioned within the hollow housing body. The seal has a first movable end and a second movable end. A first seal surface and a first hollow housing inner surface define a first hollow housing cavity. A second seal surface and a second hollow housing surface define a second hollow housing cavity. The seal is configured to seal wellbore fluid in the first hollow housing cavity from fluid in the second hollow housing cavity when the wellbore tubular is disposed in the hollow housing body and the seal is engaged to the wellbore tubular. Each of the first movable end and the second movable end are configured to change a length of a third sealing surface shared between the seal and the wellbore tubular. The first retainer ring is positioned within the hollow housing body and mechanically coupled to the first movable end. The first retainer ring slides within the hollow housing body to move the first movable end. The first retainer ring and the hollow housing body define a first chamber. The first chamber is configured to be pressurized to change a pressure in the first chamber. The first movable end is configured to move between a first location and a second location responsive to change of the pressure in the first chamber. The second retainer ring is positioned within the hollow housing and mechanically coupled to the second movable end. The second retainer ring slides within the hollow housing body to move the second movable end. The second retainer ring and the hollow housing body define a second chamber. The second chamber is configured to be pressurized to change a pressure in the second chamber. The second movable end is configured to move between a first location and a second location responsive to change of the pressure in the second chamber. The third chamber is defined by an outside surface of the seal and an inside surface of the hollow housing body. The third chamber is configured to be pressurized to change a pressure in the third chamber. Changing the pressure in the third chamber changes a sealing force applied by the seal to the wellbore tubular. The pump is fluidically coupled to the first chamber, the second chamber, and the third chamber. The pump is configured to pressurize the first chamber, the second chamber, and the third chamber. The controller is configured to receive a signal representing a sensed adjustable wellbore sealing system condition and transmit a signal to the pump in response to the adjustable wellbore sealing system condition to change the pressure in the first chamber to move the first movable end of the seal to change the length of the seal, to change the pressure in the second chamber to move the second movable end of the seal to change the length of the seal, and to change the pressure in the third chamber to change the sealing force applied by the seal to the wellbore tubular. The sensors are configured to be disposed in the hollow housing body. The sensors are operatively coupled to the controller. The sensors are configured to sense the adjustable wellbore sealing system condition and transmit signals representing the adjustable wellbore sealing assembly condition to the controller.

The method includes prior to receiving the wellbore tubular through the hollow housing body, positioning the first moving end, positioning the second moving end, and de-pressurizing the third chamber to reduce the sealing force to accommodate the wellbore tubular within the hollow housing body. The method further includes moving the wellbore tubular to contact the seal. The method further includes, in response to moving the wellbore tubular to contact the seal, pressurizing the third chamber. The method further includes, in response to pressurizing the third chamber, increasing the sealing force on the wellbore tubular. The method further includes sealing the hollow housing first cavity from the hollow housing second cavity.

In some implementations, the method can, where the wellbore tubular is moving through the hollow housing body in a first direction and where the first direction is toward the wellbore, positioning the first moving end and positioning the second moving end can further include positioning the first movable end at a first chamber first location and positioning the second moveable end at a second chamber second location, increasing the length of the sealing surface against the wellbore tubular and configuring the seal to accept tubular movement in the first direction.

In some implementations, the method can, where the wellbore tubular is moving through the hollow housing body in a second direction and where a second direction is away from the wellbore, positioning the first moving end and positioning the second moving end can further include positioning the first movable end at a first chamber second location and positioning the second moveable end at a second chamber first location, increasing the length of the sealing surface against the wellbore tubular and configuring the seal to accept wellbore tubular movement in the second direction.

In some implementations, the wellbore tubular can further include, where a first wellbore tubular body with a first diameter and a second wellbore tubular body with a second diameter, where the second diameter is larger than the first diameter, positioning the first moving end and positioning the second moving end can further include positioning the first movable end at a first chamber first location. The method can further include positioning the second moveable end at a first chamber first location, maintaining the length of the sealing surface against the second wellbore tubular body and configuring the seal to accommodate the second wellbore tubular body with the second diameter. The method can further include, in response to moving the first wellbore tubular body through the hollow housing body, positioning the second movable end at the second chamber second location to decrease length of the sealing surface against the first wellbore tubular body.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
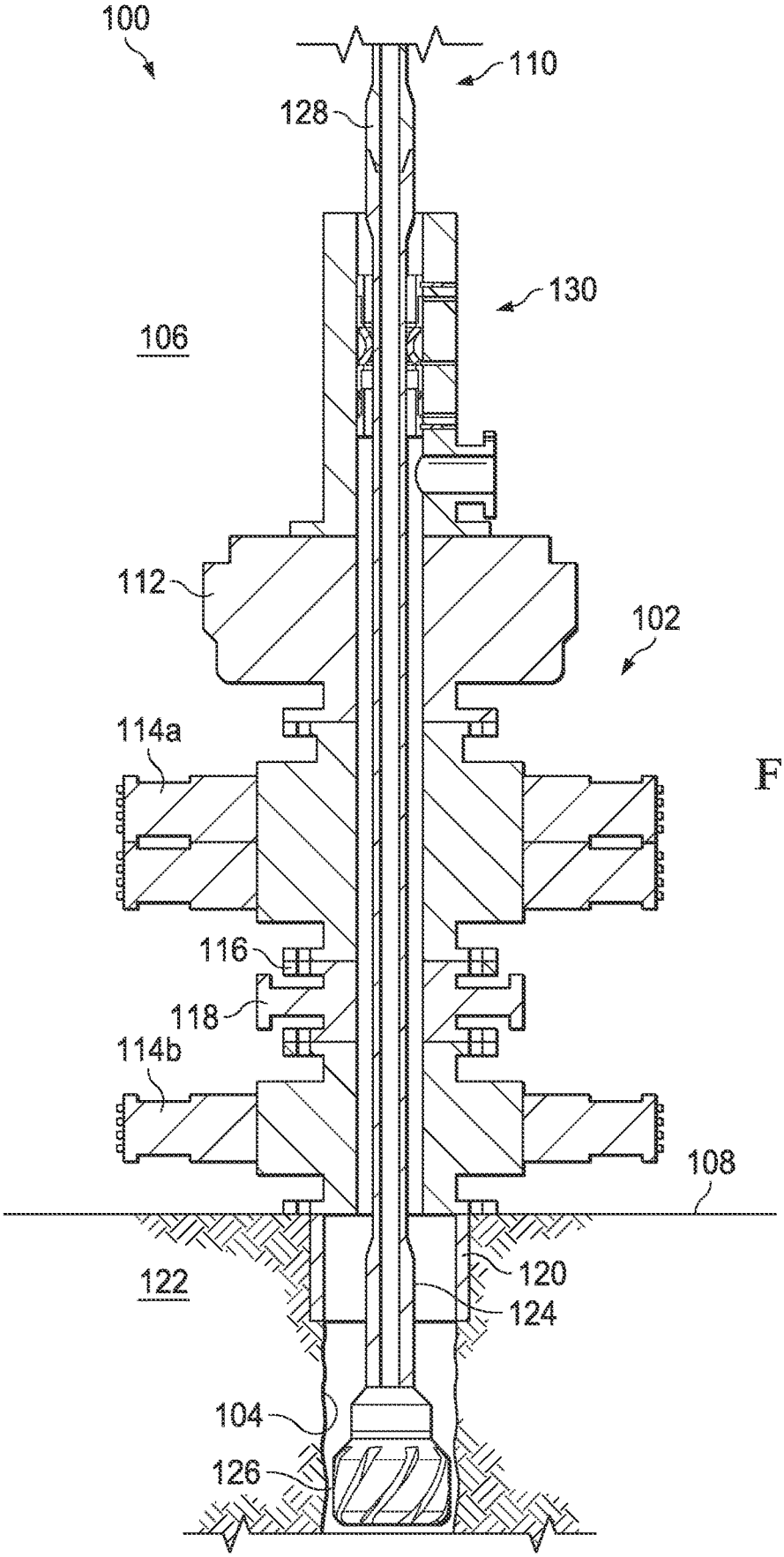
FIG. 1 is a schematic view of an adjustable wellbore sealing system attached to a wellbore.

A wellhead is the physical hardware and equipment coupled to a wellbore used to control wellbore fluid flow and pressure. Wellheads can contain seals, rotating control devices, manifolds, blowout preventers, spools, diverters, rotating heads, flow tees, rams, choke lines, isolation valves, or safety valves. The wellhead is positioned on a surface of the Earth. Tubulars, for example drill pipes, workover pipes, or production tubulars, pass through the wellhead into the wellbore. Movement into the wellbore towards a bottom surface of the wellbore can be referred to as downhole or downward movement or the downhole or downward direction. Some tubulars can be removed from the wellbore. Movement out of the wellbore in a direction away from the bottom surface of the wellbore toward the surface of the earth can be referred to as uphole movement or upward movement. The direction of movement out of the wellbore in a direction away from the bottom surface of the wellbore toward the surface of the earth can be referred can be referred to as an uphole direction or upward direction. Tubulars can rotate as they pass through the wellhead. The tubulars can have sections where the outer diameter of the tubular increases or decrease. In some cases, the change in outer diameter can be a 10 degree angle or even as great as a 90 degree angle, for example, resulting in a sharp, rapid change in the outer diameter as that section passes through the wellhead. The change in the outer diameter of the tubulars can create an uneven sealing surface. The movement and rotation of the tubulars through the wellhead can create friction and resulting damage on wellhead components. The outer surface of the tubulars can have marks or large scars from drilling rig tools that can damage wellhead components. Specifically, wellhead sealing component integrity can be compromised by tubular movement, tubular rotation, tubular outer diameter change, and/or tubular outer surface damage.

The present disclosure relates to a system and a method for adjustably sealing fluid flow at a wellhead. The adjustable wellbore sealing assembly includes a hollow housing body and a seal positioned within the hollow housing body. A wellbore tubular can be disposed in the hollow housing body and pass through the seal. The seal engages the wellbore tubular to seal the wellbore fluid from the atmosphere. The seal has two movable ends to adjust the length of the seal engaged to the wellbore tubular. The seal can be pressurized or depressurized to adjust the force that the seal engages the wellbore tubular.

Implementations of the present disclosure can increase seal longevity. For example, the seal can experience less damage due to shear forces caused by contacting a fixed elastomer seal with a moving metal wellbore tubular. For example, the seal can experience less damage due to marks or scars in the wellbore tubular outer surface. Personnel safety can be improved. For example, reducing the number of seal failures can expose fewer workers to dangerous conditions. Also, environmental safety can be improved. For example, component integrity can be increased, reducing the likelihood of an uncontrolled release of fluids and gases into the area surrounding a wellbore. The surrounding area can be the surface of the Earth when the wellhead is installed on land or the ocean when the wellhead is a subsea wellhead. Non-productive time can be reduced due to seal failure and subsequent replacement requiring removing a drill string from the wellhead, shutting blowout preventers and replacing damaged or broken seals. Improved options to divert drilling fluid and can create a pressurized barrier with the aid of a rotating control device seal constantly engaged around the outside diameter of a drill pipe are achieved.

FIG. 1 shows an adjustable wellbore sealing system 100 with an adjustable wellbore sealing assembly 130 coupled to a wellhead 102 to seal the wellhead 102 from the atmosphere 106 of the Earth. The wellhead 102 is positioned on a surface 108 of the Earth and mechanically coupled to a wellbore 104 to fluidically seal the wellbore 104. A wellbore tubular 110 can pass through the wellhead 102 to be disposed in the wellbore 104.

The wellhead 102 can include multiple components mechanically coupled to one another in various configurations. All of the wellhead components are hollow to allow the wellbore tubular 110 to pass into the wellbore 104. The wellhead 102 can include fixed seal rotating control device 112 to seal around the wellbore tubular 110. The wellhead 102 can include blowout preventers (for example, blowout preventers 114*a* and 114*b*) to rapidly seal the wellhead 102 in an emergency such as a blowout. A blowout is an uncontrolled release of wellbore fluids and gases. The wellhead 102 can include a spool 116. The spool 116 has a cylindrical hollow body 118 to conduct fluids. The spool 116 can have multiple flanges 118 configured to mechanically couple to other components such as valves (not shown) to direct fluid flow or to instruments (not shown) to sense fluid conditions. The valves can be connected to a choke and kill conduit to control well pressure excursions. Alternatively or in addition, the valves can be connected to a drilling mud system during drilling operations.

The various wellhead 102 components can be constructed from a metal such as steel or an alloy. The various wellhead 102 components can have nominal outer diameters that can be between 6 inches and 20 inches. The dimensions and material properties of the wellhead 102 components can conform to an American Petroleum Institute (API) standard or a proprietary specification.

The wellhead 102 is mechanically coupled to a casing 120 disposed in the wellbore 104. The wellbore 104 is drilled from the surface 108 of the Earth and extends downward through the formations 122 (or a formation or a portion of a formation) of the Earth. The wellbore 104 conducts a formation fluid contained in the formations 122 of the Earth to the surface 108. By conducting, it is meant that, for example, the wellbore 104 permits flow of the formation fluid to the surface 108. Some of the formations 122 of the Earth are filled with both liquid and gaseous phases of various fluids and chemicals including water, oils, and different types of hydrocarbon gases. The wellbore 104 is fluidically coupled to some of the formations 122 of the Earth.

Figure 2:
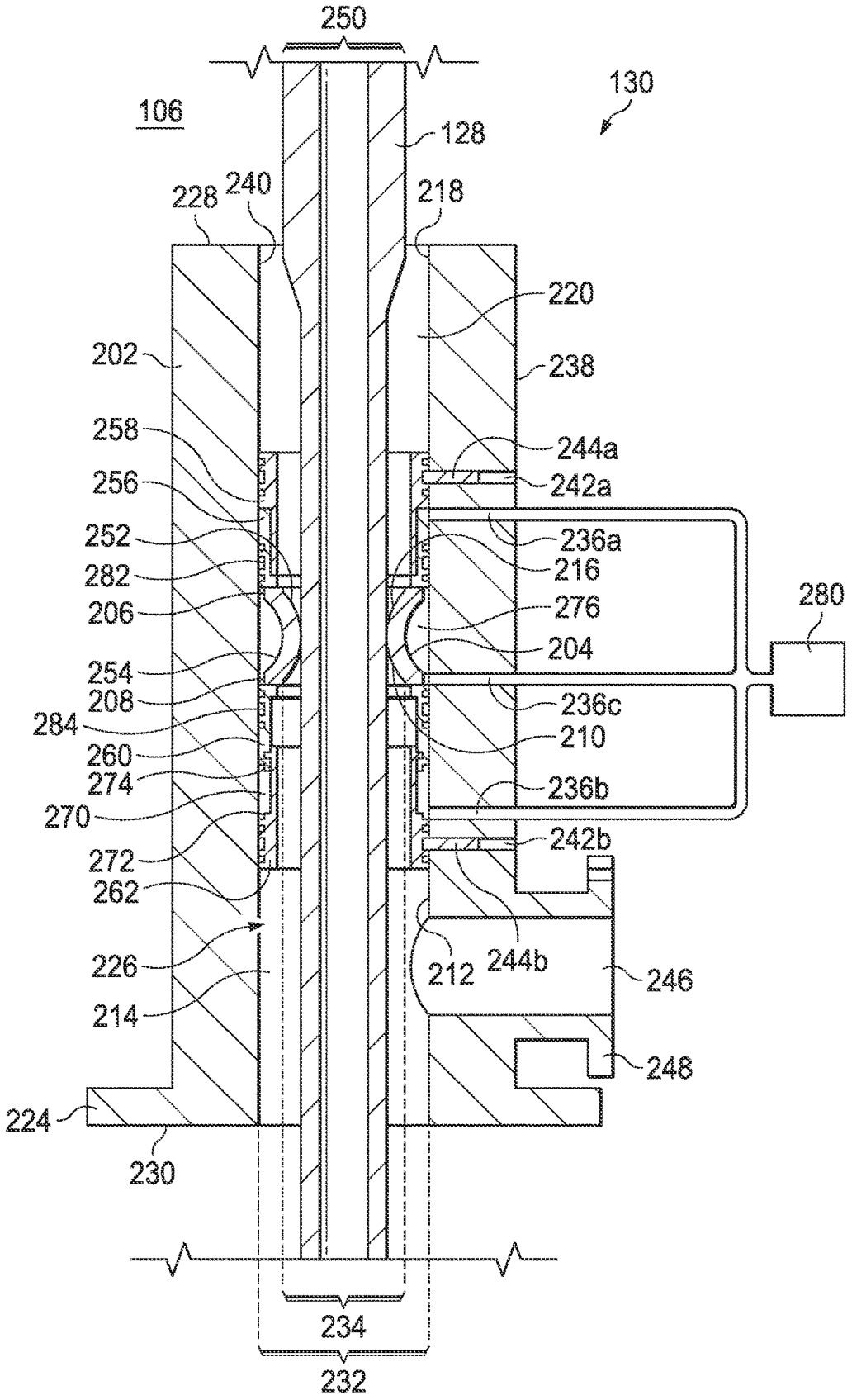
FIG. 2 is a cross-sectional view of a wellbore tubular disposed within the adjustable wellbore sealing system of FIG. 1.

The wellbore tubular 110 passes through the wellhead 102 and into the wellbore 104. For example, the wellbore tubular 110 can be a drilling assembly including a drill pipe 124 and a drill bit 126. The drill pipe 124 is rotated and moved axially in an uphole direction and in a downward direction within the wellbore 104 by a drilling rig (not shown) to conduct drilling operations with the drill bit 126. In some implementations, the drill pipe 124 has tool joints 128 that can have a larger diameter than a nominal outer diameter 250 (as shown in FIG. 2) of the drill pipe 124. For example, a five inch outer diameter drill pipe can have a seven to eight inch tool joint outer diameter. The change in the outer diameter between the drill pipe 124 and drill pipe tool joint 128 can be rapid, for example, with a high degree angle between 10 to 60 degrees. Alternatively, the wellbore tubular 110 can be a completion tubing or a casing being moved in a downhole direction into the wellbore 104 to complete the wellbore 104. In some implementations, a casing can have a sharp, 90 degree angle on a tool joint.

FIG. 2 shows a detailed cross-sectional view of the adjustable wellbore sealing assembly 130 with a wellbore tubular 110 disposed within the adjustable wellbore sealing system 130. The adjustable wellbore sealing system 130 includes a hollow housing body 202. The hollow housing body 202 is configured to receive a wellbore tubular 110. For example, the hollow housing body 202 has a cylindrical cavity 226 extending through the hollow housing body 202 from a top surface 228 to the bottom surface 230. The portion of the hollow housing body 202 which defines the cylindrical cavity 226 has an inner surface 240 of the hollow housing body 202. The cylindrical cavity 226 has a diameter 232 sufficient large to pass the wellbore tubular 110. The bottom surface 230 is mechanically coupled to the other components of the wellhead 102. In some implementations, the bottom surface 230 of the hollow housing body 202 includes a mechanical connector 224 to couple the hollow housing body to the wellhead 102. For example, the mechanical connector 224 can be a flange coupled to the wellhead 102 by fastening devices (not shown). For example, fastening devices can be bolts and nuts or studs and nuts. The hollow housing body 202 is configured to accept a seal 204 (described later).

In some implementations, the hollow cavity body 202 has conduits (for example, a first conduit 236*a*, a second conduit 236*b*, and a third conduit 236*c*) extending from an outer surface 238 of the hollow housing body 202 to the inner surface 240 of the hollow housing body 202. The first conduit 236*a*, the second conduit 236*b*, and the third conduit 236*c* are configured to flow a fluid from a control fluid source 280 outside the hollow housing body 202 into the cylindrical cavity 226 to move the seal 204.

The control fluid source 280 is configured to store a pressurized control fluid. The control fluid source 280 provides pressurized control fluid through the first conduit 236*a*, the second conduit 236*b*, and the third conduit 236*c* to move the seal 204. For example, the control fluid source 280 can be a hydraulic pump or a hydraulic accumulator and the control fluid can be hydraulic fluid. Alternatively, the control fluid source 280 can be a pre-charged pressure tanks containing pressurized nitrogen or air controlled by a pressure manifold for pneumatic control.

In some implementations, the nominal operating pressure of the adjustable wellbore sealing system 130 is 1000 psi. The control fluid source 280 can provide the control fluid at lower or higher pressures. For example, the adjustable wellbore sealing system 130 can operate at 50 psi, 500 psi, 800, psi, 1200 psi, 2000 psi, or 5000 psi.

In some implementations, the hollow cavity body 202 has a passage 246 which extend from an outer surface 238 of the hollow housing body 202 to the inner surface 240 of the hollow housing body 202. The passage 246 conducts fluids. The passage can have a flanges 248 configured to mechanically couple to other components such as valves (not shown) to direct fluid flow or instruments (not shown) to sense fluid conditions. The valves can be connected to a choke and kill conduit to control well pressure excursions. Alternatively or in addition, the valves can be connected to a drilling mud system during drilling operations to flow drilling mud and/or drilling cuttings from the wellbore 104.

The seal 204 is positioned within the hollow housing body 202 in the cylindrical cavity 226. The seal 204 has ring-like, hollow cylindrical shape. The seal 204 has an inner diameter 234 sufficiently large to pass the wellbore tubular 110. The seal 204 has a first movable end 206 and a second movable end 208. A first seal surface 210 and a first hollow housing inner surface 212 define a first hollow housing cavity 214. The first hollow housing cavity 214 is contained within the cylindrical cavity 226. The first hollow housing cavity 214 can be exposed to a pressure of the wellbore 104. A second seal surface 216 and a second hollow housing surface 218 define a second hollow housing cavity 220. The second hollow housing cavity 220 is contained within the cylindrical cavity 226. The second hollow housing cavity 220 can be exposed to a pressure of the atmosphere 106. The seal 204 is configured to seal a wellbore fluid in the first hollow housing cavity 214 from a fluid in the second hollow housing cavity 220 when the wellbore tubular 110 is disposed in the hollow housing body 202 and the seal 204 is engaged to the wellbore tubular 110. The first movable end 206 and the second movable end 208 move to change a length of a third seal surface 252 shared between the seal 204 and the wellbore tubular 110. The third seal surface 252 provides the sealing boundary between the first hollow hosing cavity 214 and the second hollow housing cavity 220.

The seal 204 can be constructed of an elastomer. In some implementations, the seal 204 may be constructed of multiple elastomers with different material properties. The seal 204 can be constructed of layers of different elastomers, for example, a softer elastomer that engages the wellbore tubular 110 and more flexible elastomer that deflects in response to a change in the wellbore tubular 110 outer diameter 250.

In some implementations, the seal 204 can include seal sensors (not shown). The seal sensors can be embedded within the seal 204 or be exposed to the first seal surface 210, the second seal surface 216, the third seal surface 252, or the fourth seal surface 254 to sense seal 204 conditions and transmit a signal representing seal conditions to a controller (not shown, described later). Seal sensors may include temperature sensors, pressure sensors, stress/strain sensors, acoustic emission sensors, or wear detection sensors. For example, a wear detection sensor can transmit a signal generating an alarm indicating that the seal may lose its ability to seal the tubular and may need to be replaced in short period of time. This alarm may alert personnel to change the sequence of drilling operations to replace the seal in a safest and most efficient way during drilling operations. Similarly, the acoustic emission sensor might send signal to the controller that seal is allowing some fluid to pass by the tubular under normal conditions and therefore will indicate that seal might lose its ability to seal shortly and will need a replacement or pressure adjustments to control seal inflation. The controller will receive signals and data from sensors and compare to the normal, standard expected values such as pressure, acoustic noise, or wear. If actual values are out of desired ranges, then the controller can send signal to operator to indicate the status of the system. For example, a signal can be visual using designated devices like displays, lights, sound signals, or a combination of visual and sound signals. The controller can send signals about the status of the system even if all values are in a normal operating range. For example, showing a green light, then such light might change to orange or red if there is a required attention to the system or/and seal condition. For example, a temperature sensor stress/strain sensors, acoustic emission sensors, or wear detection sensors can send signals to the controller to monitor for seal damage.

Figure 3:
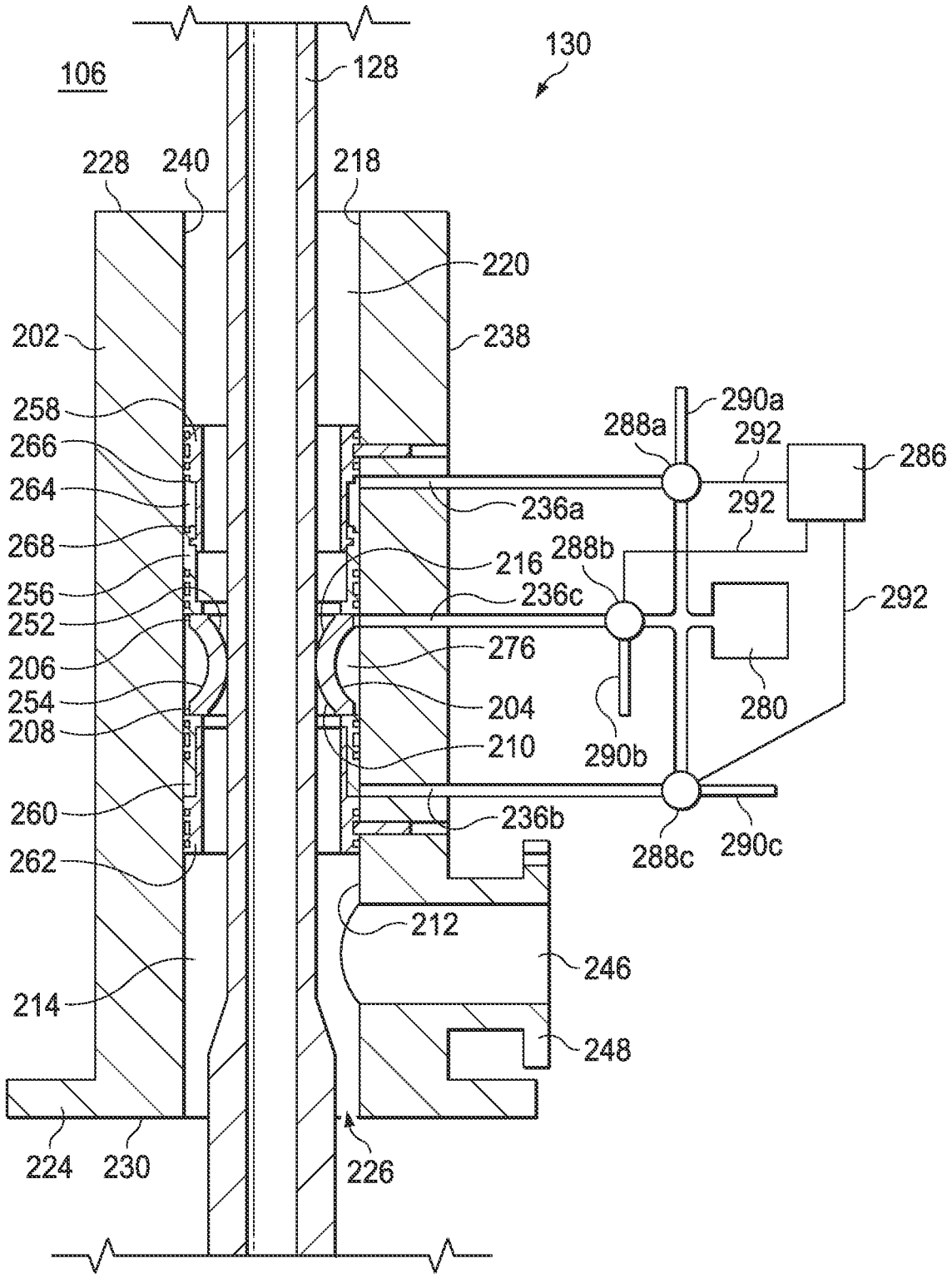
FIG. 3 is another cross-sectional view of a wellbore tubular disposed within the adjustable wellbore sealing system of FIG. 1.

A first movable end ring 256 is mechanically coupled to the first movable end 206 of the seal 204. The first movable end ring 256 slides in between the inner surface 240 of the hollow cavity body 202 and a first movable end retaining body 258. The first movable end retaining body is fixed within the cylindrical body 226. Referring to FIG. 3, the first movable end ring 256, the inner surface 240, and the first movable end retaining body 258 define a first chamber 264. The first chamber 264 has a first end 266 and a second end 268. The first chamber 264 is fluidically coupled to the first conduit 236*a* to receive the pressurized control fluid from the control fluid source 280 and return the pressurized control fluid back to the control fluid source 280. The first movable end ring 256 can slide from the first end 266 to the second end 268, expanding the volume of the first chamber 264 in response to a flow of control fluid from the fluid source. As the first movable end ring 256 moves from the first end 266 to the second end 268, the seal 204 compresses, increasing the length of the third seal surface 252 shared between the seal 204 and the wellbore tubular 110. The first movable end ring 256 can slide from the second end 268 to the first end 266, contracting the volume of the first chamber 264 in response to a flow of control fluid back to the fluid source. As the first movable end ring 256 moves from the second end 268 to the first end 266, the seal 204 expands, decreasing the length of the third seal surface 252 shared between the seal 204 and the wellbore tubular 110.

Referring to FIG. 3, in some implementations, the control fluid source 280 includes a controller 286 configured to operatively control the supply of fluid from the control fluid source 280 to move the seal 204. The controller 286 is operatively coupled to multiple fluid pressure control valves 288*a*, 288*b*, and 288*c* disposed in the first conduit 236*a*, the second conduit 236*b*, and the third conduit 236*c*, respectively. The fluid pressure control valves 288*a*, 288*b*, and 288*c* control the flow of fluid through the first conduit 236*a*, the second conduit 236*b*, and the third conduit 236*c* from the control fluid source 280 to the first chamber 264, a second chamber 270, and a third chamber 276 (discussed later) respectively, to move and pressurize the seal 204. To depressurize the first chamber 264, the second chamber 270, and the third chamber 276 respectively, to move and depressurize the seal 204, the fluid pressure control valves 288*a*, 288*b*, and 288*c* can flow the fluid out through multiple fluid return conduits 290*a*, 290*b*, and 290, each fluidically coupled to the fluid pressure control valves 288*a*, 288*b*, and 288*c*, respectively.

Referring to FIG. 2, a second movable end ring 260 is mechanically coupled to the second movable end 208 of the seal 204. The second movable end ring 260 slides in between the inner surface 240 of the hollow cavity 202 and a second movable end retaining body 262. The second movable end retaining body is fixed within the cylindrical body 226. The second movable end ring 260, the inner surface 240, and the second movable end retaining body 262 define a second chamber 270. The second chamber 270 has a first end 272 and a second end 274. The second chamber 270 is fluidically coupled to the second conduit 236*b* to receive the pressurized control fluid from the control fluid source 280 and return the pressurized control fluid back to the control fluid source 280. The second movable end ring 260 can slide from the first end 272 to the second end 274, expanding the volume of the second chamber 270 in response to a flow of control fluid from the fluid source. As the second movable end ring 260 moves from the first end 272 to the second end 274, the seal 204 compresses, increasing the length of the third seal surface 252 shared between the seal 204 and the wellbore tubular 110. The second movable end ring 260 can slide from the second end 274 to the first end 272, contracting the volume of the second chamber 270 in response to a flow of control fluid back to the fluid source. As the second movable end ring 260 moves from the second end 274 to the first end 272, the seal 204 expands, decreasing the length of the third seal surface 252 shared between the seal 204 and the wellbore tubular 110.

Referring to FIGS. 2 and 3, the first movable end ring 256, the second movable end ring 260, the inner surface 240, and the seal 204 define a third chamber 276. The third chamber 276 is fluidically coupled to the third conduit 236*c* to receive the pressurized control fluid from the control fluid source 280 and return the pressurized control fluid back to the control fluid source 280. The third chamber 276 can receive the pressurized control fluid from the control fluid source 280 increasing the pressure in the third chamber 276. As the pressure in the third chamber 276 increases, a sealing force applied by the seal 204 to the wellbore tubular 110 increases. The third chamber 276 can return the pressurized control fluid back to the control fluid source 280, decreasing the pressure in the third chamber 276. As the pressure in the third chamber 276 decreases, the sealing force applied by the seal 204 to the wellbore tubular 110 decreases.

In some implementations, the seal 204, the first movable end ring 256, and/or the second movable end ring 260 can be fitted with bearings allowing for minimum friction rotation inside the housing cavity body 202 once the seal 204 is engaged to the wellbore tubular 110. The bearings can reduce or prevent tubular to seal sliding and wear during tubular rotation. The first movable end retaining body 258 or the second movable end retaining body 262 may also rotate or may be stationary. A locking mechanism 244*a* or 244*b*, described later, can fix the first movable end retaining body 258 or the second movable end retaining body 262 to prevent longitudinal movement inside the hollow housing body 202. For example, the locking mechanism 244*a* or 244*b* can be a bearing type assembly with a circular groove in the first movable end retaining body 258 and the second movable end retaining body 262, respectively As shown in FIG. 2, the first movable end ring 256 can include a first bearing 282 and the second movable end ring 260 can include a second bearing 284 to allow the seal 204 and the first movable end ring 226 and the second movable end ring 260 to rotate.

In some implementations, the hollow cavity body 202 has a first void 242*a* and a second void 242*b* which extend from an outer surface 238 of the hollow housing body 202 to the inner surface 240 of the hollow housing body 202. The first void 242*a* and the second void 242*b* are configured to accept a first locking mechanism 244*a* and a second locking mechanism 244*b*, respectively, to prevent the first movable end retaining body 258 and second movable end retaining body 262 the from moving. For example, the first locking mechanism 244*a* and a second locking mechanism 244*b* can be pins that slide within the first void 242*a* and the second void 242*b*, respectively. Alternatively, the first locking mechanism 244*a* and a second locking mechanism 244*b* can be bolts.

Figure 6:
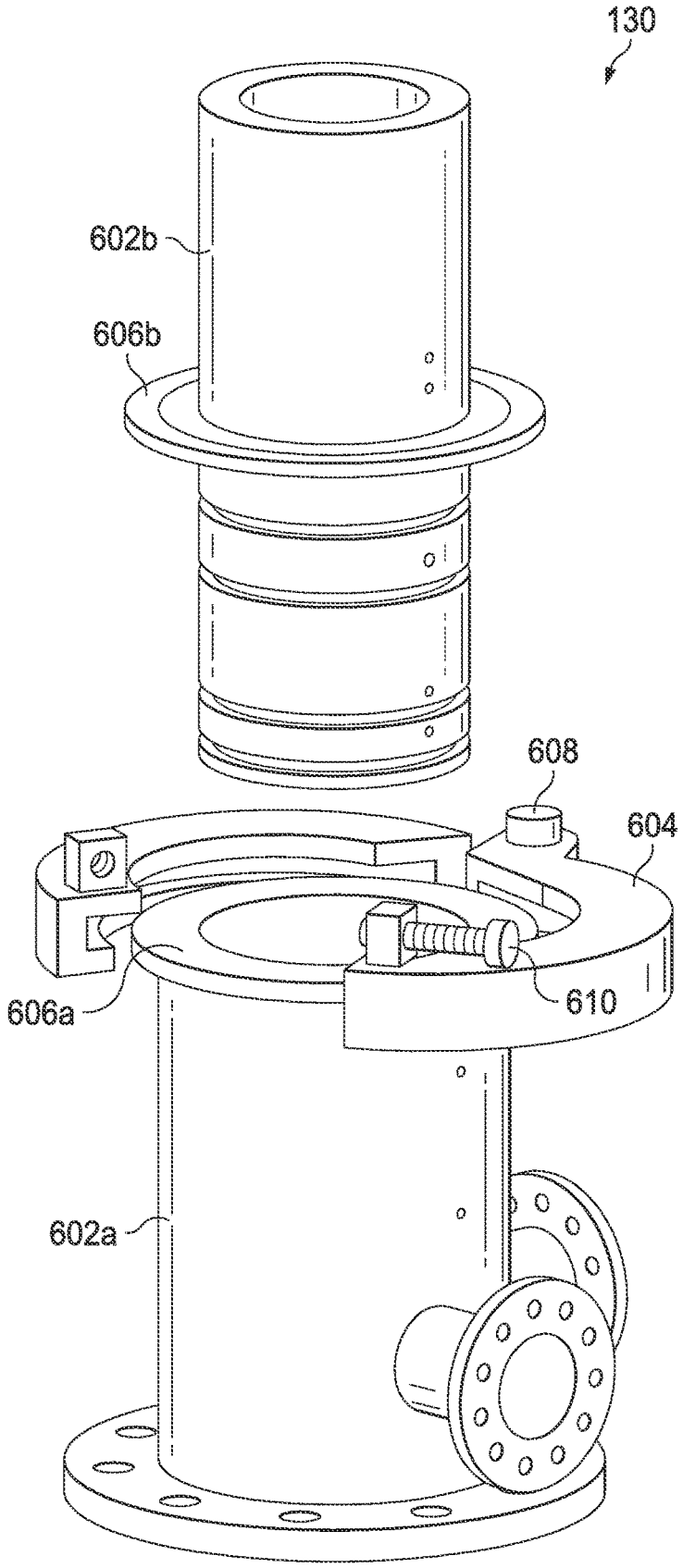
FIG. 6 is a perspective view of another adjustable wellbore sealing system.

In some implementations, as shown in FIG. 6, the hollow housing body 202 can be split into two parts, a stationary lower hollow housing body 602*a* and a removable upper hollow housing body 602*b*. The stationary lower hollow housing body 602*a* can include a first flange 606*a* configured to accept a second flange 606*b* of the removable upper hollow housing body 602*b*. This implementation can include a clamp 604 configured to clamp the stationary lower hollow housing body stationary 602*a* and the removable upper hollow housing body 602*b* together. The clamp 604 can have a hinge 608 configured to allow the clamp 604 to open or close around the first flange 606*a* and the second flange 606*b* when the stationary lower hollow housing body 602*a* and the removable upper hollow housing body 602*b* are coupled together. The clamp 604 can include a locking device 610 configured to secure the clamp 604 together about the first flange 606*a* and the second flange 606*b*. For example, the locking device 610 can be a fastener such as a bolt, another clamp, or a hydraulic piston.

In some implementations, various sensors (not shown) can be disposed within the adjustable wellbore sealing assembly 130 to sense adjustable wellbore sealing assembly 130 conditions and transmit signals representing the conditions to the controller 278. Sensors may include, for example, a temperature sensor, a pressure sensor, a stress/strain sensor, or an acoustic emission sensor.

In some implementations, the temperature sensor can collect temperature data for reference seal performance and to allow adjust pressure readings with temperature. In some implementations, multiple Pressure sensors can sense pressure inside the first chamber 264, the second chamber 270, and the third chamber 276 to allow for accurate control of seal shape and pressure. For example, when a larger diameter tubular body will be transitioning through the seal, the pressure sensor can give the first readings about changing seal diameter. Additionally, pressure sensor can measure pressure in first hollow hosing cavity 214 to confirm the seal working to seal from the environment. A higher pressure in first hollow hosing cavity 214 might indicate a requirement to increase the overall pressure in the system to ensure an adequate seal.

In some implementations the stress/strain sensor will sense readings of the seal operation. The stress/strain values from this sensor should be kept as low as possible to increase seal life. In order to keep these stress/strain values low, pressure might be adjusted in the overall system.

In some implementations, the acoustic sensor can identify the lowest pressure allowed in the system before the seal will leak. Additionally, if the seal will wear or get damaged, the acoustic sensor can indicate a leak and severity of this leak across the seal. Some smaller leaks could be addressed with increasing pressure in respective chambers.

In some implementations, the temperature sensor, the pressure sensor, the stress/strain sensor, or the acoustic emission sensor can transmit a single representing the sensed conditions to the controller 278 for the controller 278 to monitor trends in conditions indicating component failure. In some implementations, the first chamber 264, the second chamber 270, and the third chamber 276 can have a corresponding pressure sensor (not shown) to monitor fluid pressure inside the respective chamber. In some implementations, a directional sensor may sense the direction of movement and rotation of the wellbore tubular 110. In some implementations, a sensor can be a camera to sense detect the wellbore tubular 110 and changes in wellbore tubular outer diameter 250. In some implementations, a proximity sensor can detect the wellbore tubular 110 and changes in wellbore tubular outer diameter 250. In some implementations, the sensor can be coupled to the drilling rig to receive to data from a drilling computer generating command to control the wellbore tubular 110. For example, a command can be sent to a top drive on the drilling rig to rotate or move the attached drill pipe in an upward direction or a downward direction.

The adjustable wellbore sealing assembly 130 can include the controller (not shown). The controller can receive signals representing sensed wellbore sealing assembly 130 from the sensors described earlier and transmit a signal to the control fluid source 280 (described earlier) to pressurize or depressurize the first chamber 264, the second chamber 270, or the third chamber 276 based on the adjustable wellbore sealing assembly 130 conditions. The controller can, based on the signals representing the sensed wellbore 104 conditions, calculate a seal length and a seal force of the third seal surface 252 to seal wellbore 104 fluid in the first hollow housing cavity 214 from fluid in the second hollow housing cavity 220 when the wellbore tubular 110 is disposed in the hollow housing body 202 and the seal 204 is engaged to the wellbore tubular 110. The controller can be a non-transitory computer-readable storage medium storing instructions executable by one or more computer processors, the instructions when executed by the one or more computer processors cause the one or more computer processors generate a signal to pressurize or depressurize the first chamber 264 to move the first movable end 206 of the seal 204 changing the length of the seal 202, to pressurize or depressurize the second chamber 270 to move the second movable end 208 of the seal 204 changing the length of the seal 204, or to pressurize or depressurize the third chamber 276 to change the sealing force applied by the seal 204 to the wellbore tubular 110.

A typical operation can include moving the wellbore tubular 110 downwards into the hollow housing body 202 into the wellbore 104. The sequence of operations for moving the wellbore tubular 110 downwards into the hollow housing body 202 into the wellbore 104 follows. Examples of operations involving moving the wellbore tubular 110 downwards into the hollow housing body 202 into the wellbore 104 include drilling the wellbore 104 or running drill pipes in hole. When it is expected to move a wellbore tubular 110 in a downward direction through the adjustable wellbore sealing assembly 130, the adjustable wellbore sealing assembly 130 can be set as shown in FIG. 2. For example, the wellbore 104 pressure can be 500 psi, the first chamber 264 pressure can be 800 psi, the second chamber 270 pressure can be 1500 psi, and the third chamber 276 pressure can be 1200 psi. Such a setup allows the seal 204 to engage around the wellbore tubular 110 and prepare for a larger diameter tool joint 128 to move downwards through the seal 204. In some implementations, this setup can be called a system reset position for the wellbore tubular 110 moving downwards. Alternatively, when an increase in pressure will be seen in the third chamber 276, for example, in response to a wellbore tubular larger diameter tool joint 128 to move downwards through the seal 204, the pressure in second chamber 270 can be reduced to close or equal to the pressure in third chamber 276. This alternative setup can also be a system reset position for the wellbore tubular 110 moving in a downward direction.

Figure 4:
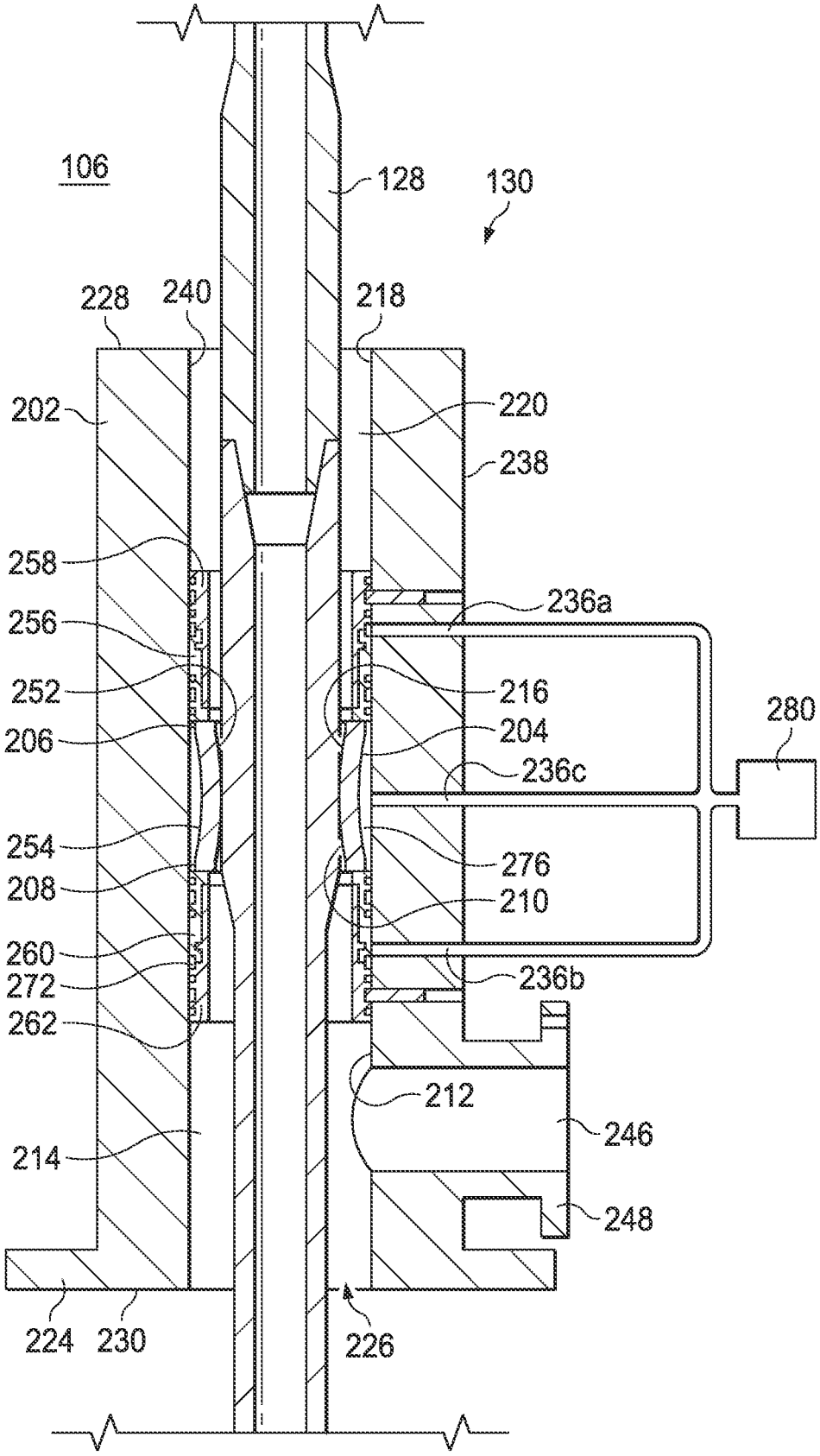
FIG. 4 is a cross-sectional view of another wellbore tubular disposed within the adjustable wellbore sealing system of FIG. 1.

The larger pressure in the second chamber 270 will allow the second movable end ring 260 to slide from the second chamber first end 272 in the upward direction to the second chamber second end 274, increasing the volume in second chamber 270, compressing the seal 204 against the wellbore tubular 110. As the wellbore tubular 110 continues to move in the downhole direction, the tool joint 128 contacts the seal 204. As shown in FIG. 4, when the tool joint 128 starts to squeeze through the seal 204 in the downward direction, the pressures and fluid volumes in the first chamber 264, the second chamber 270, and the third chamber 276 can be adjusted to allow the seal 204 to adjust to a different shape by changing the sealing length and the sealing force. To allow the seal 204 change in length while the wellbore tubular 110 is moving in the downward direction, the second movable end ring 260 can move toward the second chamber second end 274 in a downward direction, while the first movable end ring 256 stays at the first chamber first end 266. This can be achieved by reducing pressure in the second chamber 270. Alternatively, this can be achieved by increasing pressure in the first chamber 264 and the third chamber 276.

In some implementations, the pressures in the first chamber 264, the second chamber 270, and the third chamber 246 can be monitored to detect the larger diameter tool joint 128 approaching the seal 204. For example, when the larger diameter tool joint 128 moving in the downward direction engages the seal 202, the pressure in the third chamber 276 will increase due to seal 204 deflection compressing the control fluid in the third chamber 276. The pressure in the third chamber 246 could reach a pre-determined pressure set point, at which point control fluid is drawn from the third chamber 276 to maintain the same pressure or reduce the pressure in the second chamber 270. After the tool joint 128 passes through the seal 204, the pressure in the second chamber 270 is increased again to reset the system back to the position ready for another tool joint 128 to pass through the seal 204 in the downward direction.

Another typical operation can include moving the wellbore tubular 110 upwards into the hollow housing body 202 from the wellbore 104. The sequence of operations for moving the wellbore tubular 110 upwards into the hollow housing body 202 into the wellbore 104 follows. Examples of operations involving moving the wellbore tubular 110 downwards into the hollow housing body 202 into the wellbore 104 include pulling the drill pipe out of the wellbore 104 or reaming a stand (a section of drill pipe) to clean out wellbore cuttings from the wellbore 104. When it is expected to move a wellbore tubular 110 upwards through the adjustable wellbore sealing assembly 130, the adjustable wellbore sealing assembly 130 can be set as shown in FIG. 3. For example, the wellbore 104 pressure can be 500 psi, the first chamber 264 pressure can be 1500 psi, the second chamber 270 pressure can be 800 psi, and the third chamber 276 pressure can be 1200 psi. Such setup allows for the seal 204 to engage over the wellbore tubular 110 and prepare for a larger diameter tool joint 128 to move upwards through the seal 204. This alternative setup can also be a system reset position for the wellbore tubular 110 moving upwards.

The larger pressure in the first chamber 264 will allow the first movable end ring 256 to slide from the first chamber first end 266 in the downward direction to the first chamber second end 268, compressing the seal 204 against the wellbore tubular 110. As the wellbore tubular 160 continues to move in the uphole direction, the tool joint 128 contacts the seal 204. When the tool joint 128 starts to squeeze through the seal 204 in the upward direction, the pressures and fluid volumes in the first chamber 264, the second chamber 270, and the third chamber 276 can be adjusted to allow seal 204 to adjust to a different shape by changing the sealing length and the sealing force. To allow the seal 204 change in length while the wellbore tubular 110 is moving in the upward direction, the first movable end ring 256 can slide toward the first chamber first end 266 in an upward direction, while the second movable end ring 260 stays at the second chamber first end 272. This can be achieved by reducing pressure in the first chamber 264. Alternatively, this can be achieved by increasing pressure in the second chamber 270 and the third chamber 276.

In some implementations, the pressures in the first chamber 264, the second chamber 270, and the third chamber 246 can be monitored to detect the larger diameter tool joint 128 approaching the seal 202. For example, when the larger diameter tool joint 128 moving in the upwards direction engages the seal 204, the pressure in the third chamber 276 will increase due to seal 204 deflection compressing the control fluid in the third chamber 276. The pressure in the third chamber 276 could reach a pre-determined pressure set point, at which point control fluid is drawn from the third chamber 276 to maintain the same pressure or reduce the pressure in the first chamber 264. After the tool joint 128 passes through the seal 204, the pressure in the first chamber 264 is increased again to reset the system back to the position ready for another tool joint 128 to pass through the seal 204 in an upward direction.

In some implementations, the wellbore tubular 110 movement direction (upward or downward) can be determined by the controller by comparing the pressure signals from pressure sensors in the first chamber 264, the second chamber 270, and the third chamber 246 and sampling the pressure signals from pressure sensors in first chamber 264, the second chamber 270, and the third chamber 246 for changes. When a wellbore tubular 110 changes direction, change in pressure in the first chamber 264, the second chamber 270, and the third chamber 246 will result. The change in pressure in the first chamber 264, the second chamber 270, and the third chamber 246 is caused by friction between the seal 204 and the wellbore tubular 110 pushing the first movable end ring 256 or the second movable end ring 260 in the direction of wellbore tubular 110 travel, generating additional force acting on the first chamber 264 or the second chamber 270, respectively.

Certain implementations have been described to adjustably seal a wellbore 104, specifically, adjustably sealing a wellbore 104 at a wellhead with an adjustable wellbore sealing assembly 130 with a single seal 204. The techniques described here can alternatively or additionally be implemented to adjustably seal the wellbore 104 with additional seals substantially similar to seal 204 described earlier. For each such implementation, the seal 204 described earlier as being disposed hollow cavity body 202 can include multiple seals mechanically coupled together. Alternatively, a seal assembly including multiple seal sets of the first movable end retaining body, the first movable end ring, the seal, the second movable end ring, and the second movable end retaining body can be positioned in the hollow cavity body. In some implementations, where multiple seals are used, some of the components (the first movable end retaining body, the first movable end ring, the seal, the second movable end ring, and the second movable end retaining body) can be shared between the seal sets.

For example, a seal set can be fitted inside a seal set housing. The seal set housing containing a single seal set can be positioned within the hollow cavity body 202. Multiple seal set housings each containing a single seal set can be positioned within the hollow housing body 202. The seal set housing can contain multiple seal sets. In some implementations, the seal set housing can include a bearing to allow the seal set housing to rotate within the hollow housing body 202. The bearings are substantially similar to the bearings described earlier.

Figure 5:
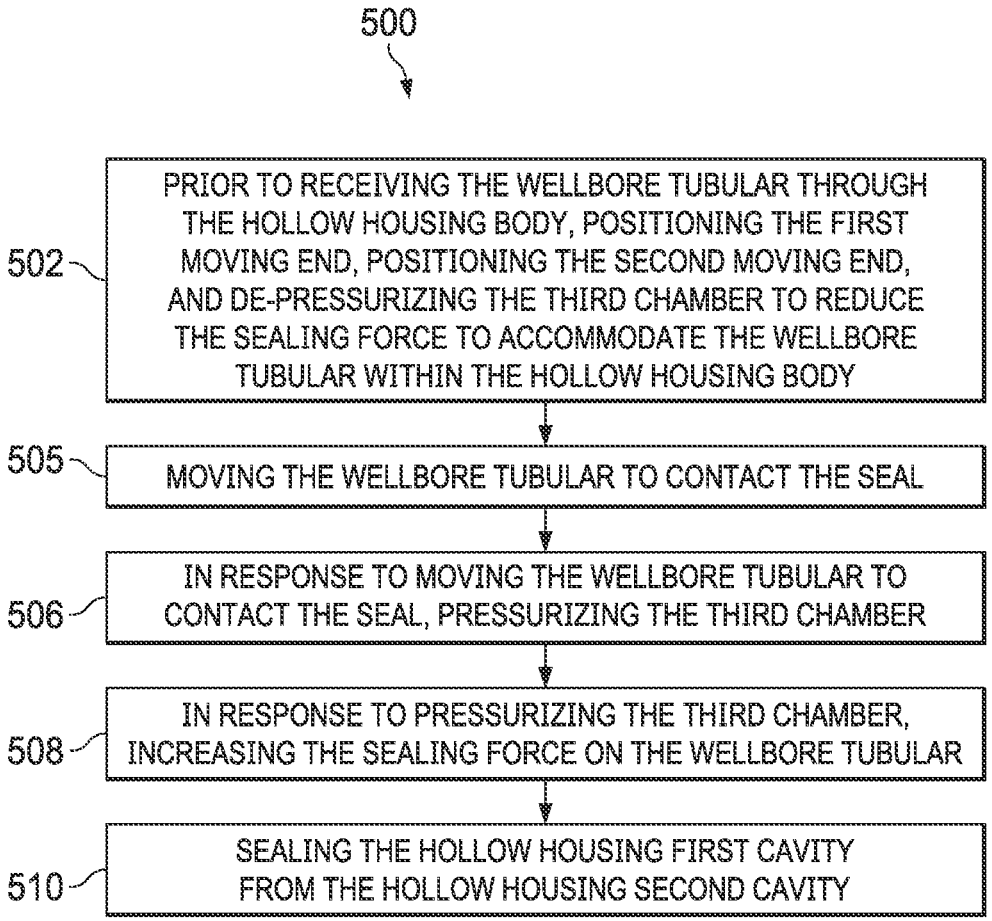
FIG. 5 is a flow chart of an example method of adjustably sealing a fluid flow at a wellhead according to the implementations of the present disclosure.

FIG. 5 is a flow chart of an example method 500 of adjustably sealing a wellbore with an adjustable wellbore sealing system. At 502, in a wellhead of a wellbore in which a wellbore sealing assembly is installed, prior to receiving the wellbore tubular through the hollow housing body, a first moving end is positioned, a second moving end is positioned, and a third chamber is de-pressurized to reduce a sealing length and a sealing force to accommodate the wellbore tubular within the hollow housing body. The adjustable wellbore sealing system includes a hollow housing body, a seal, a first retainer ring, a second retainer ring, a pump, a controller, and multiple sensors. The hollow housing body is configured to receive a wellbore tubular. The seal is positioned within the hollow housing body. The seal has a first movable end and a second movable end. A first seal surface and a first hollow housing surface define a first hollow housing cavity. A second seal surface and a second hollow housing surface define a second hollow housing cavity. The seal is configured to seal fluid in the first hollow housing cavity from fluid in the second hollow housing cavity when the wellbore tubular is disposed in the hollow housing body and the seal is engaged to the wellbore tubular. Each of the first movable end and the second movable end is configured to change a length of a third sealing surface shared between the seal and the wellbore tubular. The first retainer ring is positioned within the hollow housing body and mechanically coupled to the first movable end. The first retainer ring and the hollow housing body define a first chamber. The first chamber is configured to be pressurized to change a pressure in the first chamber. The first movable end is configured to move responsive to change of the pressure in the first chamber. The second retainer ring is positioned within the hollow housing body and mechanically coupled to the second movable end. The second retainer ring slides within the hollow housing body to move the second movable end. The second retainer ring and the hollow housing body define a second chamber. The second chamber is configured to be pressurized to change a pressure in the second chamber. The second movable end is configured to move responsive to change of the pressure in the second chamber. The third chamber is defined by an outside surface of the seal and an inside surface of the hollow housing body. The third chamber is configured to be pressurized to change a pressure in the third chamber. Changing the pressure in the third chamber changes a sealing force applied by the seal to the wellbore tubular. The pump is fluidically coupled to the first chamber, the second chamber, and the third chamber to pressurize the first chamber, the second chamber, and the third chamber. The sensors are configured to be disposed in the hollow housing body. The sensors are operatively coupled to the controller. The sensors are configured to sense sealing assembly conditions and transmit signals representing the sensed sealing assembly conditions to the controller. The controller is configured to operatively control the pump in response to sealing assembly conditions. The controller is a non-transitory computer-readable storage medium storing instructions executable by one or more computer processors, the instructions when executed by the one or more computer processors cause the one or more computer processors to move the first movable end of the seal, to move the second movable end of the seal, to change the length of the seal, and to change the a sealing force applied by the seal to the wellbore tubular.

At 504, the wellbore tubular is moved to contact the seal. In some implementations, where the wellbore tubular is moving through the hollow housing body in a first direction toward the wellbore, positioning the first moving end and positioning the second moving end further includes positioning the first movable end at a first chamber first location and positioning the second moveable end at a second chamber second location, increasing the length of the sealing surface against the wellbore tubular and configuring the seal to accept tubular movement in the first direction. In some implementations, where the wellbore tubular is moving through the hollow housing body in a second direction away from the wellbore, positioning the first moving end and positioning the second moving end further includes positioning the first movable end at a first chamber second location and positioning the second moveable end at a second chamber first location, increasing the length of the sealing surface against the wellbore tubular and configuring the seal to accept wellbore tubular movement in the second direction. In some implementations, where the wellbore tubular further includes a first wellbore tubular body with a first diameter and a second wellbore tubular body with a second diameter and the second diameter is larger than the first diameter, positioning the first moving end and positioning the second moving end further includes positioning the first movable end at a first chamber first location, positioning the second moveable end at a first chamber first location, maintaining the length of the sealing surface against the second wellbore tubular body and configuring the seal to accommodate the second wellbore tubular body with the second diameter, and in response to moving the first wellbore tubular body through the hollow housing body, positioning the second movable end at the second chamber second location to decrease length of the sealing surface against the first wellbore tubular body.

At 506, in response to moving the wellbore tubular to contact the seal, the third chamber is pressurized. At 508, in response to pressurizing the third chamber, the sealing force on the wellbore tubular is increased. At 510, the hollow housing first cavity is sealed from the hollow housing second cavity.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A wellbore sealing assembly comprising:

a hollow housing body configured to receive a wellbore tubular;

a seal positioned within the hollow housing body, the seal having a first movable end and a second movable end, wherein a first seal surface and a first hollow housing inner surface define a first hollow housing cavity, and a second seal surface and a second hollow housing surface define a second hollow housing cavity, the seal configured to seal wellbore fluid in the first hollow housing cavity from fluid in the second hollow housing cavity when the wellbore tubular is disposed in the hollow housing body and the seal is engaged to the wellbore tubular, wherein each of the first movable end and the second movable end is moveable to change a length of a third seal surface shared between the seal and the wellbore tubular; and a first retainer ring positioned within the hollow housing body and mechanically coupled to the first movable end, wherein the first retainer ring slides within the hollow housing body to move the first movable end, wherein the first retainer ring and the hollow housing body define a first chamber, wherein the first chamber is configured to be pressurized to change a pressure in the first chamber, wherein the first movable end is configured to move responsive to change of the pressure in the first chamber.

2. The assembly of claim 1, further comprising a second retainer ring positioned within the hollow housing body and mechanically coupled to the second movable end, wherein the second retainer ring slides within the hollow housing body to move the second movable end, wherein the second retainer ring and the hollow housing body define a second chamber, wherein the second chamber is configured to be pressurized to change a pressure in the second chamber, wherein the second movable end is configured to move responsive to change of the pressure in the second chamber.

3. The assembly of claim 2, further comprising a third chamber defined by an outside surface of the seal and an inside surface of the housing, wherein the third chamber is configured to be pressurized to change a pressure in the third chamber, wherein changing the pressure in the third chamber changes a sealing force applied by the seal to the wellbore tubular.

4. The assembly of claim 3, further comprising a pump fluidically coupled to the first chamber, the second chamber, and the third chamber to pressurize the first chamber, the second chamber, and the third chamber.

5. The assembly of claim 4, further comprising:

a controller configured to:

receive signals representing sensed wellbore sealing assembly conditions; and transmit a signal to the pump to pressurized the first chamber, the second chamber, or the third chamber based on wellbore sealing assembly conditions; and a plurality of sensors configured to be disposed in the hollow housing body, the plurality of sensors operatively coupled to the controller, the plurality of sensors configured to sense wellbore sealing assembly conditions and transmit signals representing the sensed wellbore sealing assembly conditions to the controller.

6. The assembly of claim 5, wherein the controller is further configured to, based on the signals representing the sensed wellbore conditions, calculate a seal length and a seal force to seal wellbore fluid in the first hollow housing cavity from fluid in the second hollow housing cavity when the wellbore tubular is disposed in the hollow housing body and the seal is engaged to the wellbore tubular.

7. The assembly of claim 6, wherein the controller is a non-transitory computer-readable storage medium storing instructions executable by one or more computer processors, the instructions when executed by the one or more computer processors cause the one or more computer processors generate a signal to pressurize the first chamber to move the first movable end of the seal changing the length of the seal, to pressurize the second chamber to move the second movable end of the seal changing the length of the seal, or to pressurize the third chamber to change the sealing force applied by the seal to the wellbore tubular.

8. An adjustable wellbore sealing system comprising:

a hollow housing body configured to receive a wellbore tubular;

a seal positioned within the hollow housing body, the seal having a first movable end and a second movable end, wherein a first seal surface and a first hollow housing inner surface define a first hollow housing cavity, and a second seal surface and a second hollow housing surface define a second hollow housing cavity, the seal configured to seal wellbore fluid in the first hollow housing cavity from fluid in the second hollow housing cavity when the wellbore tubular is disposed in the hollow housing body and the seal is engaged to the wellbore tubular, wherein each of the first movable end and the second movable end is configured to change a length of a third sealing surface shared between the seal and the wellbore tubular;

a first retainer ring positioned within the hollow housing body and mechanically coupled to the first movable end, wherein the first retainer ring slides within the hollow housing body to move the first movable end, wherein the first retainer ring and the hollow housing body define a first chamber, wherein the first chamber is configured to be pressurized to change a pressure in the first chamber, wherein the first movable end is configured to move between a first location and a second location responsive to change of the pressure in the first chamber;

a second retainer ring positioned within the hollow housing and mechanically coupled to the second movable end, wherein the second retainer ring slides within the hollow housing body to move the second movable end, wherein the second retainer ring and the hollow housing body define a second chamber, wherein the second chamber is configured to be pressurized to change a pressure in the second chamber, wherein the second movable end is configured to move between a first location and a second location responsive to change of the pressure in the second chamber;

a third chamber defined by an outside surface of the seal and an inside surface of the hollow housing body, wherein the third chamber is configured to be pressurized to change a pressure in the third chamber, wherein changing the pressure in the third chamber changes a sealing force applied by the seal to the wellbore tubular;

a pump fluidically coupled to the first chamber, the second chamber, and the third chamber, the pump configured to pressurize the first chamber, the second chamber, and the third chamber;

a controller configured to:

receive a signal representing a sensed adjustable wellbore sealing system condition; and transmit a signal to the pump in response to the adjustable wellbore sealing system condition to:

change the pressure in the first chamber to move the first movable end of the seal to change the length of the seal, change the pressure in the second chamber to move the second movable end of the seal to change the length of the seal, and change the pressure in the third chamber to change the sealing force applied by the seal to the wellbore tubular; and a plurality of sensors configured to be disposed in the hollow housing body, the plurality of sensors operatively coupled to the controller, the plurality of sensors configured to sense the adjustable wellbore sealing system condition and transmit signals representing the adjustable wellbore sealing assembly condition to the controller.

9. The system of claim 8, wherein the controller is a non-transitory computer-readable storage medium storing instructions executable by one or more computer processors, the instructions when executed by the one or more computer processors cause the one or more computer processors to operatively control the pump.

10. The system of claim 8, wherein the controller is further configured to, based on the signals representing the sensed wellbore conditions, calculate a seal length and a seal force to seal wellbore fluid in the first hollow housing cavity from fluid in the second hollow housing cavity when the wellbore tubular is disposed in the hollow housing body and the seal is engaged to the wellbore tubular.

11. The system of claim 8, further comprising sensors configured to determine a wellbore tubular diameter and a wellbore tubular profile and transmit signals representing the wellbore tubular diameter and the wellbore tubular profile to the controller.

12. The system of claim 11, wherein the controller moves the first movable end and the second movable end in response to the wellbore tubular diameter or the wellbore tubular profile.

13. The system of claim 8, further comprising a conduit fluidically coupled to the second hollow housing cavity, the conduit extending through the hollow housing body to an outside surface of the hollow housing body.

14. The system of claim 13, wherein the conduit is configured to allow a drilling fluid and a drilling cutting to flow therein.

15. The system of claim 13, wherein the conduit is configured to apply a back pressure to the wellbore.

16. A method comprising:

in a wellhead of a wellbore in which a wellbore sealing assembly is installed, the wellbore sealing assembly comprising:

a hollow housing body configured to receive a wellbore tubular;

a seal positioned within the hollow housing body, the seal having a first movable end and a second movable end, wherein a first seal surface and a first hollow housing surface define a first hollow housing cavity, and a second seal surface and a second hollow housing surface define a second hollow housing cavity, the seal configured to seal fluid in the first hollow housing cavity from fluid in the second hollow housing cavity when the wellbore tubular is disposed in the hollow housing body and the seal is engaged to the wellbore tubular, wherein each of the first movable end and the second movable end is configured to change a length of a third sealing surface shared between the seal and the wellbore tubular;

a first retainer ring positioned within the hollow housing body and mechanically coupled to the first movable end, wherein the first retainer ring slides within the hollow housing body to move the first movable end, wherein the first retainer ring and the hollow housing body define a first chamber, wherein the first chamber is configured to be pressurized to change a pressure in the first chamber, wherein the first movable end is configured to move responsive to change of the pressure in the first chamber;

a second retainer ring positioned within the hollow housing body and mechanically coupled to the second movable end, wherein the second retainer ring slides within the hollow housing body to move the second movable end, wherein the second retainer ring and the hollow housing body define a second chamber, wherein the second chamber is configured to be pressurized to change a pressure in the second chamber, wherein the second movable end is configured to move responsive to change of the pressure in the second chamber;

a third chamber defined by an outside surface of the seal and an inside surface of the hollow housing body, wherein the third chamber is configured to be pressurized to change a pressure in the third chamber, wherein changing the pressure in the third chamber changes a sealing force applied by the seal to the wellbore tubular;

a pump fluidically coupled to the first chamber, the second chamber, and the third chamber to pressurize the first chamber, the second chamber, and the third chamber;

a controller; and a plurality of sensors configured to be disposed in the hollow housing body, the plurality of sensors operatively coupled to the controller, the plurality of sensors configured to sense sealing assembly conditions and transmit signals representing the sensed sealing assembly conditions to the controller, wherein the controller is configured to operatively control the pump in response to sealing assembly conditions, wherein the controller is a non-transitory computer-readable storage medium storing instructions executable by one or more computer processors, the instructions when executed by the one or more computer processors cause the one or more computer processors to move the first movable end of the seal, to move the second movable end of the seal, to change the length of the seal, and to change the a sealing force applied by the seal to the wellbore tubular;

the method comprising:

prior to receiving the wellbore tubular through the hollow housing body, positioning the first moving end, positioning the second moving end, and depressurizing the third chamber to reduce the sealing force to accommodate the wellbore tubular within the hollow housing body;

moving the wellbore tubular to contact the seal;

in response to moving the wellbore tubular to contact the seal, pressurizing the third chamber;

in response to pressurizing the third chamber, increasing the sealing force on the wellbore tubular; and sealing the hollow housing first cavity from the hollow housing second cavity.

17. The method of claim 16, wherein the wellbore tubular is moving through the hollow housing body in a first direction, wherein the first direction is toward the wellbore, positioning the first moving end and positioning the second moving end further comprises:

positioning the first movable end at a first chamber first location; and positioning the second moveable end at a second chamber second location, increasing the length of the sealing surface against the wellbore tubular and configuring the seal to accept tubular movement in the first direction.

18. The method of claim 17, wherein the wellbore tubular is moving through the hollow housing body in a second direction, wherein a second direction is away from the wellbore, positioning the first moving end and positioning the second moving end further comprises:

positioning the first movable end at a first chamber second location; and positioning the second moveable end at a second chamber first location, increasing the length of the sealing surface against the wellbore tubular and configuring the seal to accept wellbore tubular movement in the second direction.

19. The method of claim 18, wherein the wellbore tubular further comprises a first wellbore tubular body with a first diameter and a second wellbore tubular body with a second diameter, wherein the second diameter is larger than the first diameter, positioning the first moving end and positioning the second moving end further comprises:

positioning the first movable end at a first chamber first location;

positioning the second moveable end at a first chamber first location, maintaining the length of the sealing surface against the second wellbore tubular body and configuring the seal to accommodate the second wellbore tubular body with the second diameter; and in response to moving the first wellbore tubular body through the hollow housing body, positioning the second movable end at the second chamber second location to decrease length of the sealing surface against the first wellbore tubular body.

* * * * *